US006936802B2

(12) United States Patent
Ishikawa et al.

(10) Patent No.: US 6,936,802 B2
(45) Date of Patent: Aug. 30, 2005

(54) MICROWAVE OVEN SYSTEM OPERATED BASED ON RECEIVED INFORMATION RECEIVED BY IT AND MICROWAVE OVEN

(75) Inventors: Kazuhiko Ishikawa, Yamatokoriyama (JP); Kazuo Wanda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 215 days.

(21) Appl. No.: 10/275,625

(22) PCT Filed: Jun. 4, 2001

(86) PCT No.: PCT/JP01/04715

§ 371 (c)(1),
(2), (4) Date: Nov. 7, 2002

(87) PCT Pub. No.: WO01/96786

PCT Pub. Date: Dec. 20, 2001

(65) Prior Publication Data

US 2003/0141295 A1 Jul. 31, 2003

(30) Foreign Application Priority Data

Jun. 15, 2000 (JP) ..... 2000-180039

(51) Int. Cl.[7] ..... H05B 6/68

(52) U.S. Cl. ..... 219/702; 219/714; 219/720; 99/325

(58) Field of Search ..... 219/702, 714, 219/720, 685; 99/325, 451; 700/207, 211, 17

(56) References Cited

U.S. PATENT DOCUMENTS 6,444,965 B1 * 9/2002 Ha et al. ..... 219/702

FOREIGN PATENT DOCUMENTS

| | | | |
|---|---|---|---|
| EP | 0 965 795 | A2 | 12/1999 |
| EP | 1 041 860 | A3 | 10/2000 |
| EP | 1 041 860 | A2 | 10/2000 |
| JP | 59-40708 | U | 3/1984 |
| JP | 59-138822 | A | 8/1984 |
| JP | 2-106620 | A | 4/1990 |
| JP | 10-276478 | A | 10/1998 |
| JP | 10-300101 | A | 11/1998 |
| JP | 11-304159 | A | 11/1999 |
| JP | 2000-97437 | A | 4/2000 |
| JP | 2000-134676 | | 5/2000 |

* cited by examiner

*Primary Examiner*—Philip H. Leung
(74) *Attorney, Agent, or Firm*—Birch, Stewart, Kolasch & Birch, LLP

(57) ABSTRACT

On a home page of a home page storing unit (421) of a host computer (4), information related to a plurality of recipes and recipe data (MI) corresponding to each of the plurality of recipes are included. The recipe data includes a heating control code (DS141) common among different types of microwave ovens (1) for heating and cooking the corresponding recipe. The microwave oven has a memory (11A) that stores a plurality of different pieces of procedure information (heating sequence FLi, heating mode data MDi, heater down time data HDT) indicating procedure matching the type, for executing a heating operation. The microwave oven performs the heating operation in accordance with one or more pieces of procedure information read from the memory (11A) based on the heating control code. The heating control code is supplied through the host computer through a personal computer (2) to the microwave oven when a desired recipe on the home page is to be heated and cooked, and the code is registered in advance in the microwave oven when a standard recipe unique to the microwave oven is to be heated and cooked.

14 Claims, 25 Drawing Sheets

FIG.4A

114

| | MN | HLC | HDT |
|---|---|---|---|
| A → | TOAST | H-TOST | 107 |
| | SALTED ROAST | H-SIOY | 47 |
| | ROAST | H-TERI | 37 |
| | FOIL AND GRILL | H-HOIR | 49 |
| | FROZEN GRATIN | H-REGR | 118 |
| | PIZZA | H-CNPZ | 37 |
| B → | HAMBURGER | H-HMBG | 47 |
| | RICE CAKE | H-MOTI | 37 |
| | ONIGIRI | H-YKON | 47 |

FIG.4B

114

| | MN | HLC | HDT |
|---|---|---|---|
| A → | TOAST | H-TOST | 133 |
| | SALTED ROAST | H-SIOY | 86 |
| | ROAST | H-TERI | 72 |
| | FOIL AND GRILL | H-HOIR | 90 |
| | FROZEN GRATIN | H-REGR | 99 |
| | PIZZA | H-CNPZ | 81 |
| B → | HAMBURGER | H-HMBG | 99 |
| | RICE CAKE | H-MOTI | 0 |
| | ONIGIRI | H-YKON | 90 |

FIG.11 what's new | new products | news release | Mar.1999 Volum 96

Welcome to home page japan

SHORT CUT
- Digital Camera
- Original Softwara

NEWS
- SPACE DOWN
- New INTRODUCTION OF NOTE PJ
- LONG AWAITED 20 inch LIQUID CRYSTAL TV EMERGES AT LAST
- EVA ANIMATOR WORKS COMPETITION Caz net
- NET DATING SCHOOL THROUGH communi-pal TOPICS
- ·MORE SOFTWARE CONTEST WINNER ANNOUNCEMENT
- ·NEW PRODUCT INFORMATION COLOR IMAGE SCANNER
- ·NEW PRODUCT INFORMATION 18 inch LIQUID CRYSTAL MONITOR
- ·NEW PRODUCT INFORMATION HAND HELD PC

25 | 2000

25th ANNIVERSARY CAMPAIGN FOR LIQUID CRYSTAL DEVELOPMENT

USER SUPPORT CENTER

PRINTER·SCANNER USER SUPPORT CENTER

M A R C H

HOW TO USE SEARCH SYSTEM

TO Global Home Page

LOCAL AREA TELEPHONE NUMBER FOR OSAKA AREA "06", WHERE OUR COMPANY IS LOCATED, HAS BEEN CHANGED. PLEASE NOTE THE NEW AREA NUMBER HAS 4 DIGITS WITH ADDITIONAL 6 AT THE HEAD (06-6xxx-xxxx).

- WHAT'S NEW
- NEWS RELEASE
- TOPICS
- TECHNICAL LIBRARY
- ABOUT OUR COMPANY
- MICROWAVE OVEN
- BUSINESS HEADQUARTERS ·LOCAL SITES·LOCAL SELLING GUIDANCE
- NEW PRODUCTS
- INQUIRY
- ELECTRONIC DEVICES
- JOB APPLICATIONS
- INTERNATIONAL PROCUREMENT
- ENVIRONMENTAL PHILOSOPHY
- LIST OF PRODUCTS
- EVENT·PR
- NET LEADER
- ACCOMPLISHMENTS
- QUIZ & GAMES
- PHOTOVOLTAIC GENERATION

A

MI

| AD | DC | CA |
|---|---|---|
| 0000h-0007h | DC11:DATA CODE, LAST ADDRESS, TYPE CODE DATA | 8 BYTE |
| 0008h-0010h | DC2:RECIPE NAME AND FIRST ADDRESS OF HEATING DATA | 9 BYTE |
| 0011h-0016h | DC3:FIRST/LAST ADDRESS OF IMAGE PAGE ADDRESS | 6 BYTE |
| 0017h-0036h | MN:RECIPE NAME | 32 BYTE |
| 0037h-0049h | DS141:HEATING PATTERN CODE | 19 BYTE |
| 004Ah-0125h | DC4:IMAGE PAGE ADDRESS INFORMATION | 220 BYTE |
| 0126h-07FFh | DS13:DISPLAY DATA | 1754 BYTE |

FIG.19

31

| | DS13 | | DS141 |
|---|---|---|---|
| MI | MN : RECIPE NAME | ID : MATERIAL DATA | JD : HOW-TO-COOK DATA | HEATING PATTERN CODE |
| | TOFU BASED HAMBURGER | ××× | ××△ | M-TOFBG |
| | OCTOPUS, CHILI FLAVOR | △△△ | ×○× | M-MURASI |
| | CHINESE STEAMED RICE | ○○○ | △△× | M-OKOWA |
| | RICE BASED PIZZA | ××△ | ○×○ | M-RIPZ |
| | STUFFED EGGPLANT | ○×× | ○○△ | M-NASU |
| | | | | |

FIG.20A

M1

| AD:ADDRESS | DC:DATA CONTENTS | CA:CAPACITY (MAXIMUM) |
|---|---|---|
| 0000h-0007h | DC11:DATA CODE, LAST ADDRESS, TYPE CODE DATA | 8 BYTE |
| 0008h-0010h | DC2:RECIPE NAME AND FIRST ADDRESS OF HEATING DATA | 9 BYTE |
| 0011h-0016h | DC3:FIRST/LAST ADDRESS OF IMAGE PAGE ADDRESS | 6 BYTE |
| 0017h-0036h | MN:RECIPE NAME (=SPONGE CAKE) | 32 BYTE |
| 0037h-0049h | DS141:HEATING PATTERN CODE (M-SPONG) | 19 BYTE |
| 004Ah-0125h | DC4:IMAGE PAGE ADDRESS INFORMATION | 220 BYTE |
| 0126h-07FFh | DS13:DISPLAY DATA | 1754 BYTE |

FIG.20B

| | TYPE A | TYPE B |
|---|---|---|
| HEATING MODE | UP/DOWN HEATER OVEN | MICROWAVE AND UP/DOWN HEATER OVEN |
| OVEN TEMP | 170°C | 160°C |
| HEATING TIME (SEC) | Aa × G + Ba | Ab × G + Bb |
| MICROWAVE OUTPUT LEVEL | — | 700W |

FIG.21A

M1

| AD:ADDRESS | DC:DATA CONTENTS | CA:CAPACITY (MAXIMUM) |
|---|---|---|
| 0000h-0007h | DC11:DATA CODE, LAST ADDRESS, TYPE CODE DATA | 8 BYTE |
| 0008h-0010h | DC2:RECIPE NAME AND FIRST ADDRESS OF HEATING DATA | 9 BYTE |
| 0011h-0016h | DC3:FIRST/LAST ADDRESS OF IMAGE PAGE ADDRESS | 6 BYTE |
| 0017h-0036h | MN:RECIPE NAME (=FOIL AND GRILL) | 32 BYTE |
| 0037h-0049h | DS141:HEATING PATTERN CODE (M-HOIR:H-HOIR) | 19 BYTE |
| 004Ah-0125h | DC4:IMAGE PAGE ADDRESS INFORMATION | 220 BYTE |
| 0126h-07FFh | DS13:DISPLAY DATA | 1754 BYTE |

FIG.21B

| | TYPE A | TYPE B |
|---|---|---|
| HEATING MODE | TOASTER | TOASTER |
| OVEN TEMP | — | — |
| HEATING TIME (SEC) | Aa×G+Ba | Ab×G+Bb |
| MICROWAVE OUTPUT LEVEL | — | — |
| HEATER DOWN TIME | 49 | 90 |

FIG.22

| MN,HN | HPC,DS141 | MAIN MENU | SUB MENU | Internet MENU |
|---|---|---|---|---|
| BOILED VEGETABLE | M-YUDEY | O | — | — |
| MILK | M-MIRK | O | — | — |
| WARM SAKE | M-SAKE | O | — | — |
| THAW | M-DEF | O | — | — |
| FRENCH BREAD | M-FRPN | O | — | — |
| ROAST BEEF | M-RSTB | O | — | — |
| PUDDING | M-PDNG | O | — | — |
| BREAD | M-BRED | O | — | — |
| CHIFFON | M-THPCK | O | — | — |
| SPONGE CAKE | M-SPONG | O | — | — |
| APPLE PIE | M-APLPI | — | O | — |
| PAELLA | M-PAERI | O | — | — |
| CASTILLA | M-CASTR | O | — | — |
| HAMBURGER | M-HAMBG | O | — | — |
| | | | | |
| ROAST PORK | M-YAKIB | — | — | O |
| STEAM | M-MURASI | — | — | O |
| STEAMED RICE | M-OKOWA | — | — | O |

11A

11B

A

FIG.23

| MN,HN | HPC,DS141 | MAIN MENU | SUB MENU | Internet MENU |
|---|---|---|---|---|
| BOILED VEGETABLE | M-YUDEY | O | — | — |
| MILK | M-MIRK | O | — | — |
| WARM SAKE | M-SAKE | O | — | — |
| THAW | M-DEF | O | — | — |
| FRENCH BREAD | M-FRPN | O | — | — |
| ROAST BEEF | M-RSTB | O | — | — |
| PUDDING | M-PDNG | O | — | — |
| BREAD | M-BRED | — | O | — |
| CHIFFON | M-THPCK | — | O | — |
| SPONGE CAKE | M-SPONG | — | O | — |
| APPLE PIE | M-APLPI | O | — | — |
| PAELLA | M-PAERI | O | — | — |
| CASTILLA | M-CASTR | O | — | — |
| HAMBURGER | M-HAMBG | O | — | — |
| | | | | |
| ROAST PORK | M-YAKIB | — | — | O |
| STEAM | M-MURASI | — | — | O |
| STEAMED RICE | M-OKOWA | — | — | O |

11A

A → 11B

MICROWAVE OVEN SYSTEM OPERATED BASED ON RECEIVED INFORMATION RECEIVED BY IT AND MICROWAVE OVEN

This application is the national phase under 35 U.S.C. § 371 of PCT International Application No. PCT/JP01/04715 which has an International filing date of Jun. 4, 2001, which designated the United States of America.

TECHNICAL FIELD

The present invention relates to a microwave oven system and a microwave oven operating based on received information and, more specifically, a microwave oven system and a microwave oven operating based on information received through a communication network.

BACKGROUND ART

Japanese Patent Laying-Open No. 10-276478 discloses an apparatus controlling household appliances in accordance with the information supplied from an outside communication network. This laid-open application describes a household appliances control apparatus controlling various electrical appliances at home in which each electrical appliance takes in control information of the appliance from a host computer of a home page through a remote controller, a server for the household appliance control and the Internet, and each appliance attains its function in accordance with the control information.

This laid-open application describes an example in which the control information is cooking information related to cooking. The example, however, is not very practical, as specific procedure of how to obtain the cooking information desired by the user from a home page, how to supply the information to a microwave oven as the electrical appliance and how the process for heating and cooking takes process in the microwave oven are not at all described.

Japanese Patent Laying-Open No. 2-106620 discloses a technique in which heating mode of a microwave oven is controlled in accordance with a prescribed heating control pattern data. The heating pattern data applied in the laid-open application is set independently for each recipe. Therefore, it is necessary to prepare heating pattern data different for every type of recipes that can be heated and cooked. In view of the limitation of memory capacity, this approach is not practical.

DISCLOSURE OF THE INVENTION

An object of the present invention is to provide a microwave oven system and a microwave oven that are highly practical.

The microwave oven system in accordance with an aspect of the present invention includes a communication network, an information processing apparatus, a microwave oven receiving information stored in the information processing apparatus, and a host computer.

The information processing apparatus has an output unit, an input unit operated from the outside, a transmitting/receiving unit transmitting and receiving information through the communication network, and an information storage unit for storing various information including the information received at the transmitting/receiving unit.

The host computer has an information storing unit connected to the communication network, and in which home page information corresponding to home page screen displayed on the output unit is stored.

The home page information includes information related to a plurality of recipes, recipe data including heating control code for heating and cooking of the recipe, corresponding to respective ones of the plurality of recipes, common to different types of microwave ovens, and information of a transfer instruction button which is operated through the input unit, for transferring the recipe data through the communication network to the information processing apparatus.

The microwave oven has a procedure storing unit storing a plurality of different pieces of procedure information specified by heating control data and indicating procedure suitable for the type of the microwave oven for executing the heating operation. When a desired recipe among a plurality of recipes included in the home page information is to be heated and cooked, the microwave oven executes the heating operation in accordance with one or more pieces of procedure information read from the procedure storing unit, based on the heating control code corresponding to the desired recipe supplied from the information processing apparatus.

The microwave oven system in accordance with another aspect of the present invention includes a communication network, an information processing apparatus, a microwave oven performing heating operation for heating and cooking, a relay apparatus, and a host computer.

The information processing apparatus has an output unit, an input unit operated from the outside, and a transmitting/receiving unit transmitting/receiving information through the communication network. The relay apparatus has an information storage unit, and for relaying information transmitted between the microwave oven and the information processing apparatus, has one end connected to the microwave oven and the other end connected to the information processing apparatus. The host computer has an information storing unit connected to the communication network, in which home page information corresponding to the home page screen displayed on the output unit is stored.

The home page information includes information related to a plurality of recipes, recipe data including heating control data for heating and cooking of the recipe, corresponding to respective ones of the plurality of cooking recipes common to different types of microwave ovens, and information of a transfer instruction button which is operated through the input unit for transferring the recipe data through the communication network to the information processing apparatus. The microwave oven has a procedure storing unit storing a plurality of different pieces of procedure information specified by the heating control code, indicating procedure suitable for the type of the microwave oven for executing the heating operation. When a desired recipe is to be heated and cooked among a plurality of recipes in the home page information, the microwave oven executes the heating operation in accordance with one or more pieces of procedure information read from the procedure storing unit, based on the heating control code of the desired recipe supplied through the relay apparatus from the information processing apparatus.

In the above described microwave oven system, the recipe data of the plurality of recipes in the home page information include heating control code common to different types of microwave ovens. When a desired recipe among the plurality of recipes in the home page information is to be heated and cooked by each of the various types of microwave ovens, heating operation is executed in accordance with one or more pieces of procedure information read from the procedure storing unit specified by the supplied heating control code of the desired recipe.

Therefore, when recipe data of a new recipe to be downloaded to a microwave oven is developed on the side of the host computer, what is necessary is simply to determine heating control code specifying one or more pieces of procedure information to be applied to the heating operation of the recipe in one type of the microwave oven, and to register the determined code with the recipe data of the recipe. Therefore, it is unnecessary to prepare a plurality of different pieces of heating information suitable for respective types. Thus, preparation of recipe data and preparation of home page information on the side of the host computer can be facilitated, and hence this approach is practical.

Therefore, even when the types of microwave ovens to be included in the microwave oven system increases, only one type of heating control code is necessary for the recipe data of a certain recipe in the home page information. Therefore, memory expansion for the home page information is unnecessary at the host computer.

In the microwave oven, the procedure information specified by the heating control code for executing the heating operation represents the procedure that matches the type of the microwave oven. Therefore, heating and cooking can be performed in accordance with the optimal procedure for each particular type, and hence it is very convenient.

In the above described microwave oven system, the microwave oven may further have a movable heater, and the plurality of different pieces of procedure information may include information instructing an amount of movement of the heater.

Therefore, when heating and cooking is performed in the microwave oven, the amount of movement of the heater is specified not by the physical value but by the heating control code. Therefore, the capacity of the recipe data involving movement of the heater can be reduced, and hence the data can be supplied (downloaded) quickly.

In the above described microwave oven system, the microwave oven further has a heating control code storing unit in which the heating control code is written in advance corresponding to each of one or more recipes that can be heated and cooked by the microwave oven. When a prescribed recipe selected among one or more recipes is to be heated and cooked, the microwave oven may execute the heating operation in accordance with one or more pieces of procedure information read from the procedure storing unit, based on the heating control code corresponding to the prescribed recipe read from the heating control code storing unit.

Therefore, it is possible to heat and cook by the microwave oven the prescribed recipe in accordance with the optimal procedure unique to the type of the microwave oven using not only the heating control code supplied (downloaded) from the home page information of the host computer but also the heating control code corresponding to the prescribed recipe stored in the internal heating control code storing unit, in the manner similar to that described above.

In the above described microwave oven system, the heating control code storing unit may be configured such that the heating control code corresponding to the selected recipe is stored arbitrarily and additionally, in correspondence with the selected recipe.

Therefore, in the microwave oven, the heating control code corresponding to the recipe selected among one or more recipes that can be heated and cooked by the microwave oven can be additionally stored in correspondence with the selected recipe, in the heating control code storing unit. Therefore, it is possible to additionally store the heating control codes corresponding to all the recipes that can be heated and cooked by the microwave oven in the heating control code storing unit. Therefore, conveniently, heating and cooking of a recipe is possible simply by reading the corresponding heating control code from the heating control code storing unit.

In the above described microwave oven system, the selected recipe may be a desired recipe among a plurality of recipes. Therefore, the heating control code supplied (downloaded) from the home page information of the host computer can be additionally stored in the heating control code storing unit in correspondence with the desired recipe. Therefore, when the desired recipe is heated and cooked, the corresponding heating control code may simply be read from the heating control code storing unit, conveniently eliminating the process for obtaining (downloading) the same from the home page information.

The microwave oven in accordance with another aspect of the present invention performs heating operation for heating and cooking, and includes a code storing unit storing heating control codes common to different types of microwave ovens for heating and cooking each of a plurality of recipes, and a procedure storing unit storing a plurality of different pieces of procedure information indicating procedures suitable for the type of the microwave oven for executing the heating operation. The microwave oven performs the heating operation in accordance with one or more pieces of procedure information read from the procedure storing unit, based on the heating control code in the code storing unit corresponding to the recipe selected by external operation, among the plurality of recipes.

Therefore, when the heating control code of a recipe is developed, what is necessary is simply to determine a heating control code specifying one or more pieces of procedure information applied to the heating operation of the recipe for one type of microwave oven, and it is unnecessary to prepare a plurality of different pieces of heating information suitable for respective types. Therefore, development of the heating control code is facilitated, and hence this approach is practical. Even when the types of the microwave ovens increase, only one type of heating control code is necessary for a certain recipe, and hence development of the heating control code is much facilitated.

As the procedure information specified by the heating control code for executing the heating operation represents the procedure that matches the type of the microwave oven, it is possible to perform heating and cooking by the microwave oven in accordance with the optimal procedure unique to each type, and hence it is very convenient.

In the above described microwave oven, the plurality of different pieces of procedure information include one or more pieces of heating sequence information. The heating sequence information consists of a combination of one or more sequences matching the type of the microwave oven for executing the heating operation. Therefore, it is possible to perform optimal heating and cooking unique to each type, based on the heating sequence matching the type of the microwave oven.

In the microwave oven described above, the combination of one or more sequences represented by the heating sequence information includes one or more parameters for controlling the sequence. The value of one or more parameters is variably adjusted, in accordance with an instructed arbitrarily amount.

Therefore, in the combination of one or more sequences applied to heating and cooking, the sequence control parameter value may be variably adjusted in accordance with the instructed arbitrary amount so that the heating operation in accordance with the sequence is performed more flexibility and as demanded by the object of cooking, and therefore, it is very convenient and the desirable heating and cooking state can always be attained.

In the above described microwave oven, the one or more parameters may further include a period parameter representing period of the heating operation.

Therefore, the period parameter value representing the heating operation period for sequence control can variably be adjusted in accordance with the designated arbitrary amount, so that the heating operation in accordance with the sequence can be performed more flexibly and as desired for the object of cooking.

In the above described microwave oven, the arbitrary amount may be common to various different types of microwave ovens, or the amount may differ type by type of the microwave ovens.

Therefore, the parameter value of the type of which amount of adjustment is constant regardless of the type of the microwave ovens can be adjusted by a common arbitrary amount, and the parameter value of the type of which amount of adjustment varies among the different types of microwave ovens can be adjusted by the amount unique to each type. Therefore, optimal sequence control is always possible, regardless of the types.

The above described microwave oven may further have a receiving unit receiving recipe information including the heating control code corresponding to the desired recipe supplied through the communication network, and the heating control code may be stored corresponding to each of one or more recipes that are out of the selection by the external operation, in the code storing unit.

Therefore, heating control codes corresponding to respective ones of one or more recipes not selected by the external operation, that is, heating control code corresponding to the desired recipe received by the receiving unit, may be stored in the code storing unit.

The above described microwave oven may further has a movable heater, and the plurality of different pieces of procedure information may include information instructing the amount of moving the heater.

Therefore, when heating and cooking are performed by the microwave oven, the amount of movement of the heater can be specified not by a physical value but by the heating control code. Therefore, a plurality of different pieces of procedure information including the amount of movement of the heater can conveniently be designated collectively by the heating control code.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 4A and 4B represent exemplary contents of heater down time table 114 of FIG. 3.

FIG. 11 shows an example of a home page screen displayed in accordance with the home page storing unit 421 of the host computer 4 shown in FIG. 1.

FIG. 19 shows an example of the contents stored in memory 31 on the side of the relay box, in accordance with the flow chart of FIG. 17.

FIGS. 20A and 20B represent another example of the recipe information MI of each of the recipes prepared by host computer 4 and information set by microwave oven 1.

FIGS. 21A and 21B represent another example of recipe information MI for each of the recipes prepared by host computer 4 and information set by the microwave oven 1.

FIG. 22 shows a state in which a new heating pattern code is registered in a memory 11B of microwave oven 1 of type A.

FIG. 23 represents a state in which a new heating pattern code is registered in a memory 11B of a microwave oven 1 of type B.

BEST MODES FOR CARRYING OUT THE INVENTION

Embodiments of the present invention will be described-in the following.

(First Embodiment)

Figure 1:
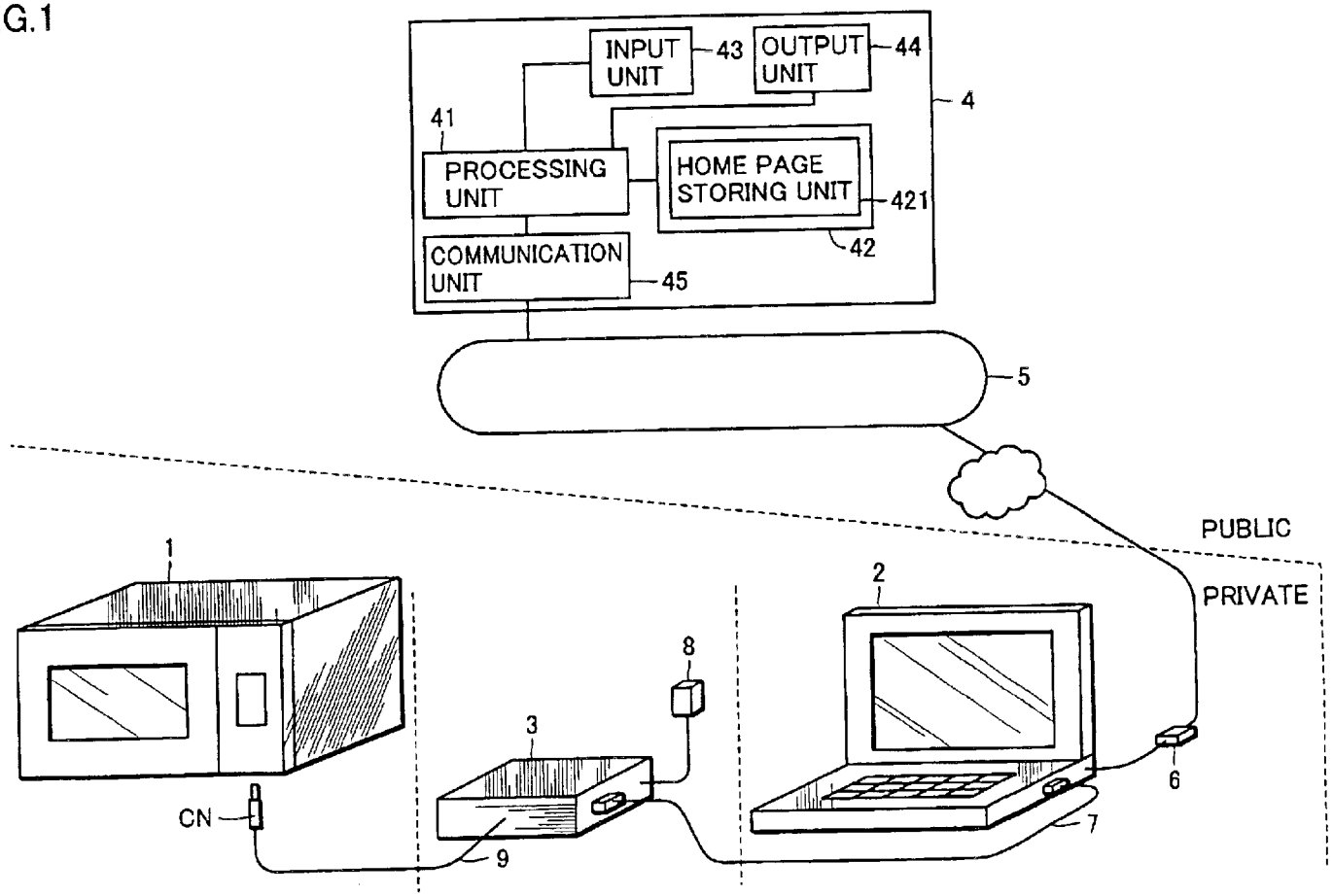
FIG. 1 is a schematic diagram showing configuration of the microwave oven system in accordance with a first embodiment of the present invention.
Figure 2:
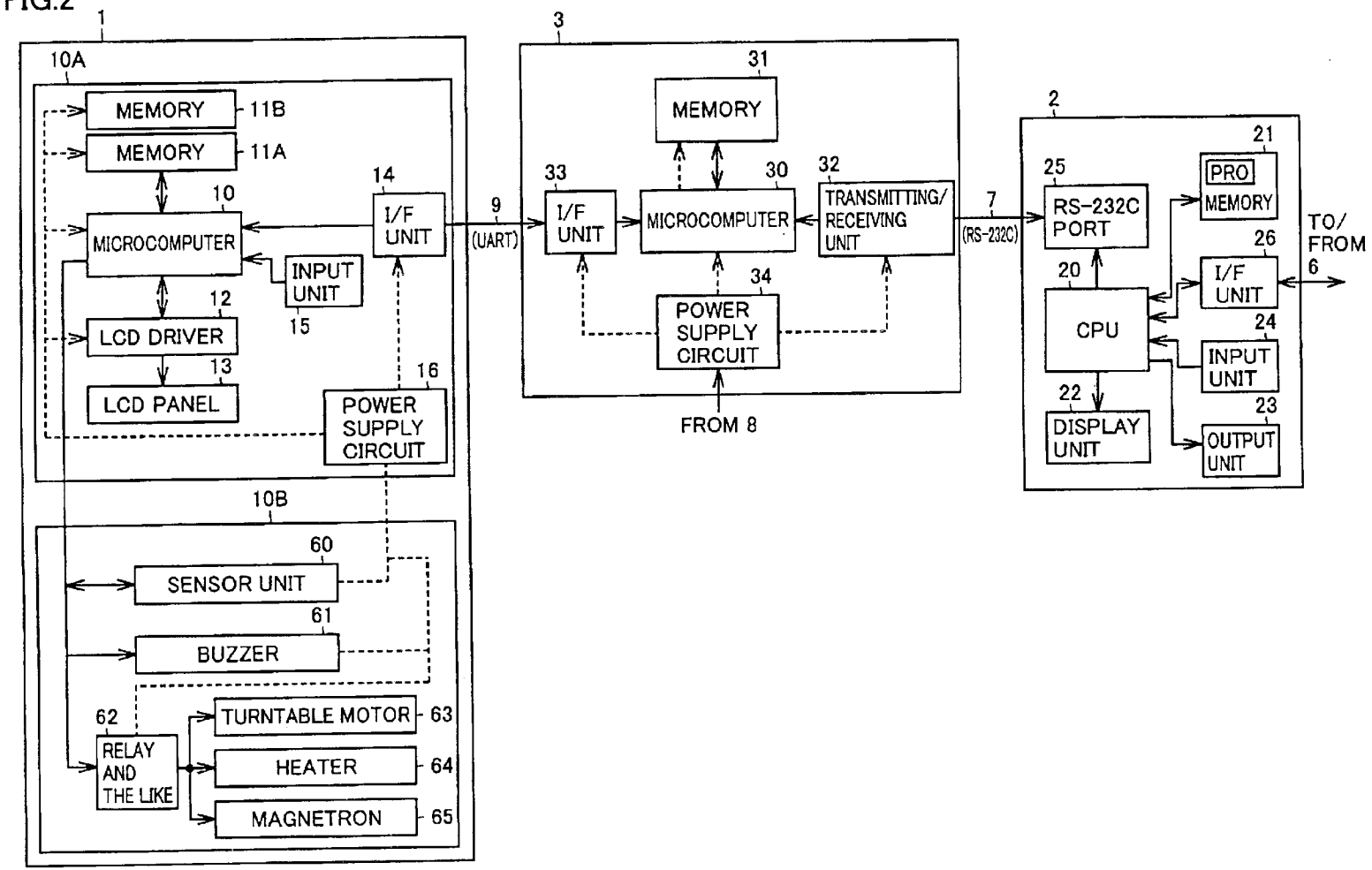
FIG. 2 is a block diagram showing configurations of respective units of FIG. 1.

FIG. 1 is a schematic diagram showing configuration of the microwave oven system in accordance with the first embodiment of the present invention. FIG. 2 is a block diagram showing configurations of respective units of FIG. 1.

Referring to FIG. 1, the microwave oven system includes, in public, the Internet 5 and a host computer 4 connected thereto, and in private, a microwave oven 1, a personal computer 2 connected through a modem 6 to the Internet 5, and a relay box 3 fed from an AC adapter 8, as a relay apparatus for connecting personal computer 2 and microwave oven 1, converting and communicating signals therebetween. In private, microwave oven 1 and relay box 3 are detachably connected by a three-line cable 9. For this connection, a connector CN at one end of the three-line cable 9 is connected to an input/output terminal, not shown, of microwave oven 1. In private, personal computer 2 and relay box 3 are connected by an RS-232C cable 7 for communication in accordance with RS-232C. The personal computer 2 may be a portable information processing terminal.

In the public host computer 4, information related to various home pages to be accessed through the Internet 5 are registered. Host computer 4 includes a processing unit 41 for centralized control and management of host computer 4 itself, a memory 42 having a home page storing unit 421 as a memory area storing information including information for constructing home page screen (hereinafter referred to as home page information), an input unit 43, an output unit 44, and a communication unit 45 for communication and connection between the Internet 5 and host computer 4.

Host computer 4 functions as a server for supplying the home page information to external information processing terminals including personal computer 2, through the Internet 5.

Here, the Internet 5 is referred to as a communication network for accessing to the information registered in host computer 4. However, it is not limited thereto. The communication network may be various dedicated or public communication networks.

Referring to FIG. 2, microwave oven 1 includes a control unit 10A and a heating unit 10B. Control unit 10A includes a microcomputer 10, a memory 11A implemented, for example, by a mask ROM (Read Only Memory), a memory 11B implemented, for example, by a non-volatile memory, an LCD (Liquid Crystal Display) panel 13 as a display unit, an LCD driver 12 for driving LCD panel 13, an I/F (Interface) unit 14 including an input/output terminal to which a connector CN is connected, an externally operable input unit 15, and a power supply circuit 16 for supplying power to respective units of microwave oven 1. Input unit 15 and LCD panel 13 are provided integrally, as a touch panel.

In the process of developing products, various functions of the microwave oven 1 are improved. As a result, even when the same recipe is to be heated and cooked, the method of heating, output level for heating (including power level, temperature) and time for heating may differ type by type of the microwave oven 1. Therefore, information for cooking matching the type of the microwave oven 1 is stored in the microwave oven 1.

Heating unit 10B performs the heating operation for heating and cooking in accordance with various pieces of information stored in memory 11A or 11B, under the control of microcomputer 10. For the heating operation, heating unit 10B includes a sensor unit 60, a buzzer 61, a relay or the like 62, a turntable motor 63 controlled by microcomputer 10 through relay or the like 62, a heater 64 freely movable in upward and downward directions in the chamber and a magnetron 65 generating microwaves for heating. The heating operation by the heating unit 10B is in accordance with the known technique, and therefore detailed description will not be given here.

Personal computer 2 includes a CPU (Central Processing Unit) 20, a non-volatile memory 21 storing various information, a display unit 22, an output unit 23, an externally operable input unit 24, an RS-232C port 25 for connecting RS-232C cable 7 with the CPU 20, and an I/F unit 26 for connecting modem 6 with CPU 20.

Relay box 3 includes a microcomputer 30, a memory 31 implemented, for example, by a flash memory, a transmitting/receiving unit 32 for connecting RS-232C cable 7 with the microcomputer 30, an I/F unit 33 for connecting the three-line cable 9 with the microcomputer 30, and a power supply circuit 34 for feeding power to respective units. The microcomputer 30 is formed including a CPU and a memory, not shown.

For the communication through the three-line cable 9, UART (Universal Asynchronous Receiver Transmitter) is adopted. When relay box 3 is not provided, microwave oven 1 can directly communicate with personal computer 2.

Here, a prescribed program PRO receiving recipe information matching the type of the microwave oven 1 used by the user from memory 42 of host computer 4 and downloading the received information to memory 11 of microwave oven 1 is stored in memory 21 of personal computer 2.

In addition to the function of heating and cooking based on the recipe information publicly available through the Internet 5, microwave oven 1 has a function of heating and cooking based on recipe information of various recipes provided inherently as standard specification (including information for boiling, warming and thawing). The recipe information provided inherently as standard specification will be referred to as standard recipe information in the following, and the name of the recipe corresponding to the standard recipe information will be referred to as the standard recipe name.

The procedure of cooking by a private microwave oven 1 using cooking information publicly available through the Internet in the host computer 4 will be described in the following.

Figure 3:
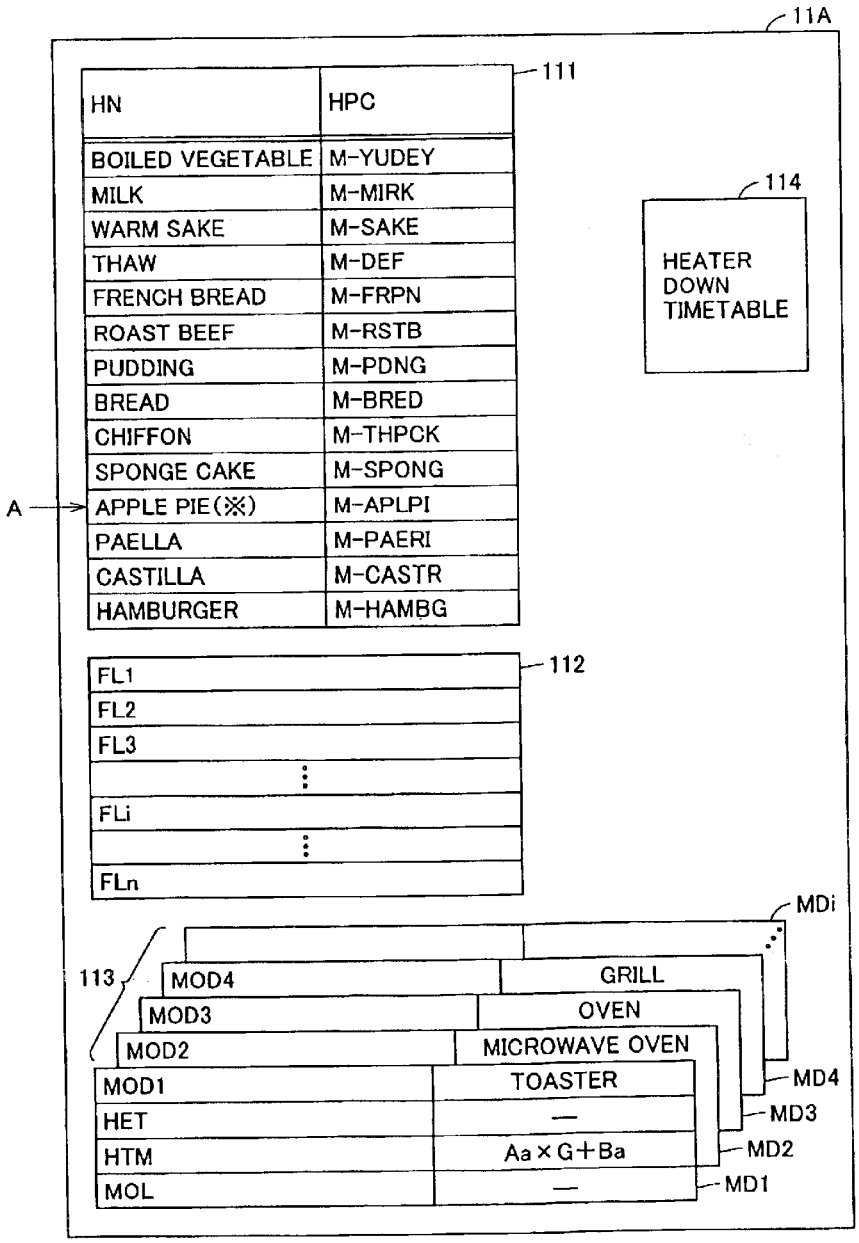
FIG. 3 represents contents stored in a memory 11A shown in FIG. 2.

FIG. 3 shows the contents stored in memory 11A of FIG. 2. Memory 11A stores heating block data group 111, pattern data group 112, heating mode data group 113 and heater down time table 114.

In heating block data group 111, standard recipe name HN and heating pattern code HPC are registered for each of the plurality of standard recipes. Referring to standard recipe name HN of heating block data group 111, there is a sign (*) on "apple pie", which sign represents that the standard recipe is included in a sub menu, which will be described later. In the heating data block group 111, other standard recipes are included in a main menu, which will be described later. For one recipe, one same heating pattern code HPC is applied, among different types of microwave ovens 1.

In pattern data group 112, heating pattern data FLi (i=1, 2, 3, . . . , n) representing sequences of a plurality of different heating operations are registered. The sequence represented by the heating pattern data FLi may sometimes represent a sequence consisting of a combination of a plurality of different other heating pattern data FLi.

The heating mode data group includes heating mode data MDi (i=1, 2, 3, . . . ) representing set information related to the heating mode, in correspondence with each of the plurality of different heating modes of microwave oven 1. For each heating mode data MDi, a heating mode code MODi is registered for uniquely designating the corresponding heating mode. Further, for the heating mode data MDi, in addition to the heating mode code MODi, oven temperature data HET, heating time (second) data HTM and microwave output level MOL are registered. The oven temperature data HET represents the temperature of the oven heated by heater 64 in the corresponding operation mode. Heating time (second) data HTM represents time period for heating and cooking using heater 64 or magnetron 65 in the corresponding operation mode. The microwave output level MOL represents output level of the microwave by the magnetron 65 in the corresponding operation mode. As shown in the figure, codes representing toaster, microwave oven, oven and grill as the heating mode code MODi, for example, are allocated to heating mode data MD1 to MD4, respectively.

FIGS. 4A and 4B represent exemplary contents of heater down time table 114 of FIG. 3. FIG. 4A shows contents of heater down time table 114 when the type of microwave oven 1 is "A". FIG. 4B shows an example of contents in heater down time table 114 when the type of microwave oven 1 is "B". Heater 64 in the chamber of microwave oven 1 can be moved downward and when the amount of downward movement is managed by the driving time of heater 64 for downward movement, the amount of downward movement of heater 64 may be managed not by a specific value of driving time but by using the recipe name MN as a keyword.

In heater down time table 114 of FIGS. 4A and 4B, recipe name MN, heater position code HLC and heater down time data HDT are registered in correspondence with each other, for each of the plurality of different recipes. The heater position code HLC which is a value common to different types of microwave ovens 1 for the same recipe name MN represents information for uniquely specifying the corresponding heater down time data HDT. The heater down time data HDT represents the time for driving heater 64 downward from the start of downward movement of the heater 64 from a prescribed initial position to the end of movement after the heater has been moved to a position appropriate for heating, when the recipe of the corresponding recipe name MN is heated and cooked by microwave oven 1 using heater 64.

As shown in FIGS. 4A and 4B, even when the recipe of the same recipe name MN is to be heated and cooked, the corresponding heater down time data HDT differs when the type of microwave oven 1 is different. For example, when the recipe name MN designated by the arrow A ("toast") is to be cooked, the heater down time data HDT for the microwave oven 1 of type A is 107, while the heater down time data HDT of microwave oven 1 of type B is 133.

In the present embodiment, a menu including a plurality of standard recipe names HN that can be selected by the user by external operation of input unit 15 of microwave oven 1 is referred to as "main menu", and a menu that cannot be selected is referred to as "sub menu". Therefore, it is possible to specify and read heating pattern data FLi, mode data MDi and heater down time data HDT based on the heating pattern code HPC corresponding to the standard recipe name HN registered in the main menu and to heat and cook the corresponding standard recipe by microwave oven 1 based on the read data. However, when the heating pattern code HPC corresponding to the standard recipe name HN registered as the sub menu is used, it is impossible to heat and cook the recipe by the microwave oven 1. Referring to FIG. 3, the standard recipe name HN ("apple pie") denoted by the arrow A, for example, is registered as the sub menu in microwave oven 1 of type A, while "bread, chiffon cake and sponge cake" may be registered as the sub menu in microwave oven 1 of type "B". As the heating function differ type by type of the microwave ovens 1, the standard recipe name HN registered as the sub menu may differ type by type.

Though such a standard recipe name HN of the sub menu cannot be selected through the input unit 15 of microwave oven 1, it is expected that it may be used for performing a new heating and cooking operation by microwave oven 1 through the Internet 5. Therefore, it is desirable to store in advance the data of all the heating patterns related to basic recipes in microwave oven 1. Therefore, though it impossible to select the recipe in the sub menu, corresponding heating pattern code HPC, heating pattern data FLi, heater down time data HDT and heating mode data HMDi are registered in advance in memory 11A of microwave oven 1.

Here, it is assumed that the contents of memory 11A are written in advance at the time of shipment from a plant of microwave oven 1, for example.

Preparation of heating pattern data FLi will be described in the following.

Generally, cooking includes basic operations such as "boil vegetables, thaw meat, boil water, simmer materials, stir and turn materials" and variation or combination of the basic operations. Therefore, for each type of microwave oven 1, there is an optimal unique heating control method for "boiling vegetables", and such optimal unique methods are developed as basic heating pattern data FLi. In this manner, the heating pattern data FLi or heating pattern data FLi as a combination of a plurality of heating pattern data FLi are developed for each type of microwave oven 1, and cooking recipe of standard recipes are formed by the heating pattern data FLi. Therefore, when a new heating control method is developed in the future, it is possible to implement the new heating control method by the information received from home page storing unit 421 through the Internet 5, as will be described later.

Figure 5:
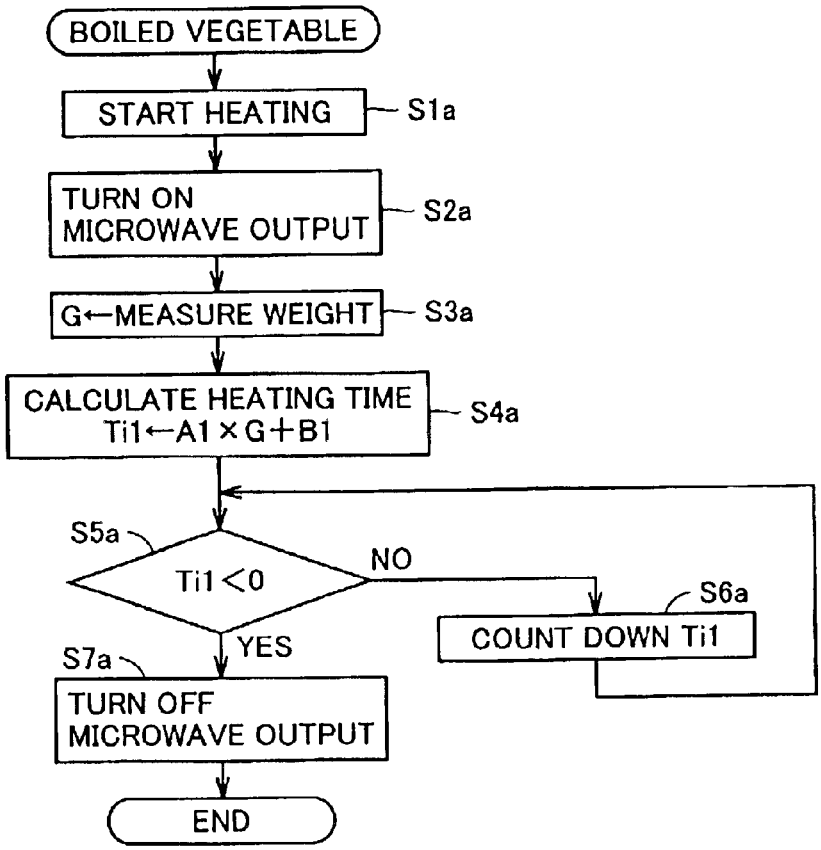
FIG. 5 is a flow chart representing heating control of a standard recipe "boiled vegetables" of a certain type of a microwave oven.

FIG. 5 is a flow chart representing heating control for the standard recipe "boiled vegetables" for the microwave oven of a certain type. The user designates the standard recipe name HN "boiled vegetables" by operating input unit 15 of microwave oven 1, to instruct heating and cooking. Then, based on the corresponding heating pattern code HPC of heating block data group 111, the corresponding heating pattern data FLi, heating mode data MDi and heater down time data HDT are read as needed, and the read data are set, and the heating operation sequence of FIG. 5 in accordance with the read corresponding heating pattern data FLi starts under the control of microcomputer 10.

First, power is fed to magnetron 65 and microwave is output (steps S1*a* and S2*a*: in the following, step S will be simply denoted by S). Thereafter, by a weight sensor, not shown, in sensor unit 60, weight of the food (vegetables) including the plate in the chamber of microwave oven 1 is measured, and the measured weight is stored as a variable G (S3*a*). Thereafter, the variable G is input to the expression "A1×G+B" for "boiled vegetables" only, ideal heating time corresponding to the amount of vegetables put in the chamber of microwave oven 1 is calculated and the calculated value is set as the variable Ti1 (S4*a*).

Thereafter, while counting down the value of variable Ti1, heating and cooking using the microwave is continued until the condition Ti1<0 is satisfied. When variable Ti1<0, microwave output from magnetron 65 is turned off, and heating and cooking end (S5*a* to S7*a*).

The sequence in accordance with the flow chart of FIG. 5 is stored as one heating pattern data FLi for boiling vegetables by microwave oven 1, in pattern data group 112 of memory 11A in advance. The storage is effected at the time of shipment from the plant of microwave oven 1, for example.

Figure 6:
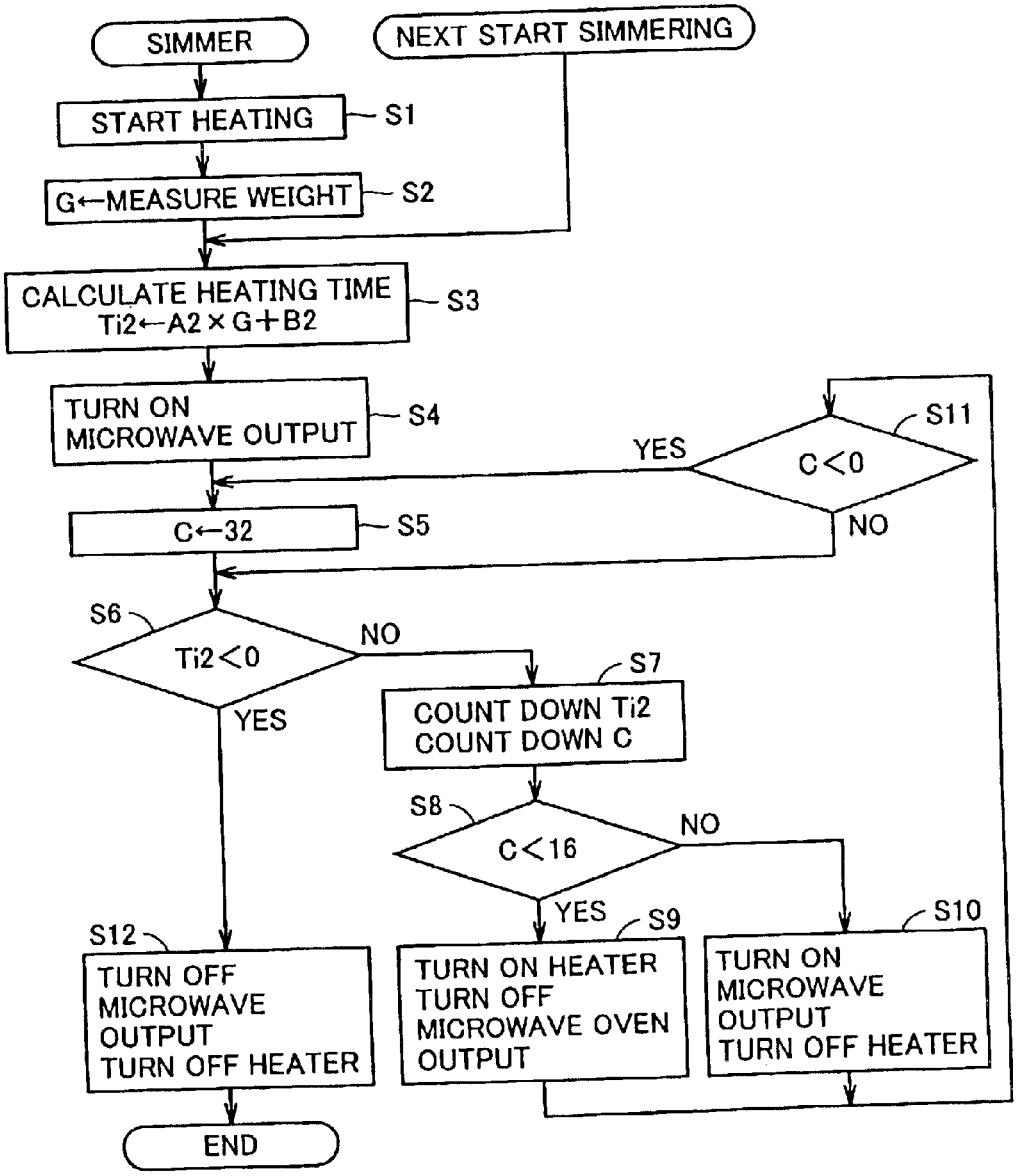
FIG. 6 is a flow chart of heating control when "simmering" cooking is performed by a microwave oven of a certain type.

FIG. 6 is a flow chart representing heating control when "simmer" cooking is performed by microwave oven 1 of a certain type. Here, it is assumed that a sequence in accordance with the flow chart of FIG. 5 has been registered in advance as heating pattern data FLi.

The user designates the standard recipe name HN "simmering" by operating input unit 15 of microwave oven 1 to instruct heating and cooking. Then, based on the corresponding heating pattern code HPC, the corresponding heating pattern data FLi, heating mode data MDi and heater down time data HDT are read as needed, the read data are set, and the sequence of heating operation shown in FIG. 6 in accordance with the corresponding heating pattern data FLi starts under the control of microcomputer 10.

First, when the heating operation starts, weight of the food including the plate put in the chamber of microwave oven 1 is measured by a weight sensor, not shown, of sensor unit 60. The measured weight is stored as variable G (S1*a* and S2*a*).

Thereafter, the variable G in which the weight is set is input to the expression "A2×G+B2) for the standard recipe "simmering" only, heating and cooking time data for ideal simmering corresponding to the amount of food put in the chamber of microwave oven 1 is calculated based on the expression, and the calculated data is set as variable Ti2. Thereafter, magnetron 65 is driven and microwave is output (S3 and SS4).

Thereafter, time data representing fixed period (for example, 32 seconds) for determining ON/OFF of power feed to magnetron 65 is set as variable C (S5).

Thereafter, counting down of variables Ti2 and C is repeated until the condition that variable Ti2<0 is attained (NO in S6, S7). In the period where 16≦C, magnetron 65 is kept conductive, microwave output is continued and heater 64 is turned off (ON in S8, S10). In the period where C<16, magnetron 65 is rendered non-conductive, microwave output is turned OFF, heater 64 is rendered conductive and control is performed to lower the power for heating. Thus, heating for simmering is performed (YES in S8, S9).

Thereafter, when the condition that variable Ti2<0 is attained, power feed to magnetron 65 and heater 64 is stopped, and heating and cooking is terminated (S12).

The sequence in accordance with such a flow chart is registered in advance as a heating pattern data FLi for simmering cooking by microwave oven 1, in pattern data group 112 of memory 11A at the time of shipment from the plant of microwave oven 1, for example.

Figure 7:
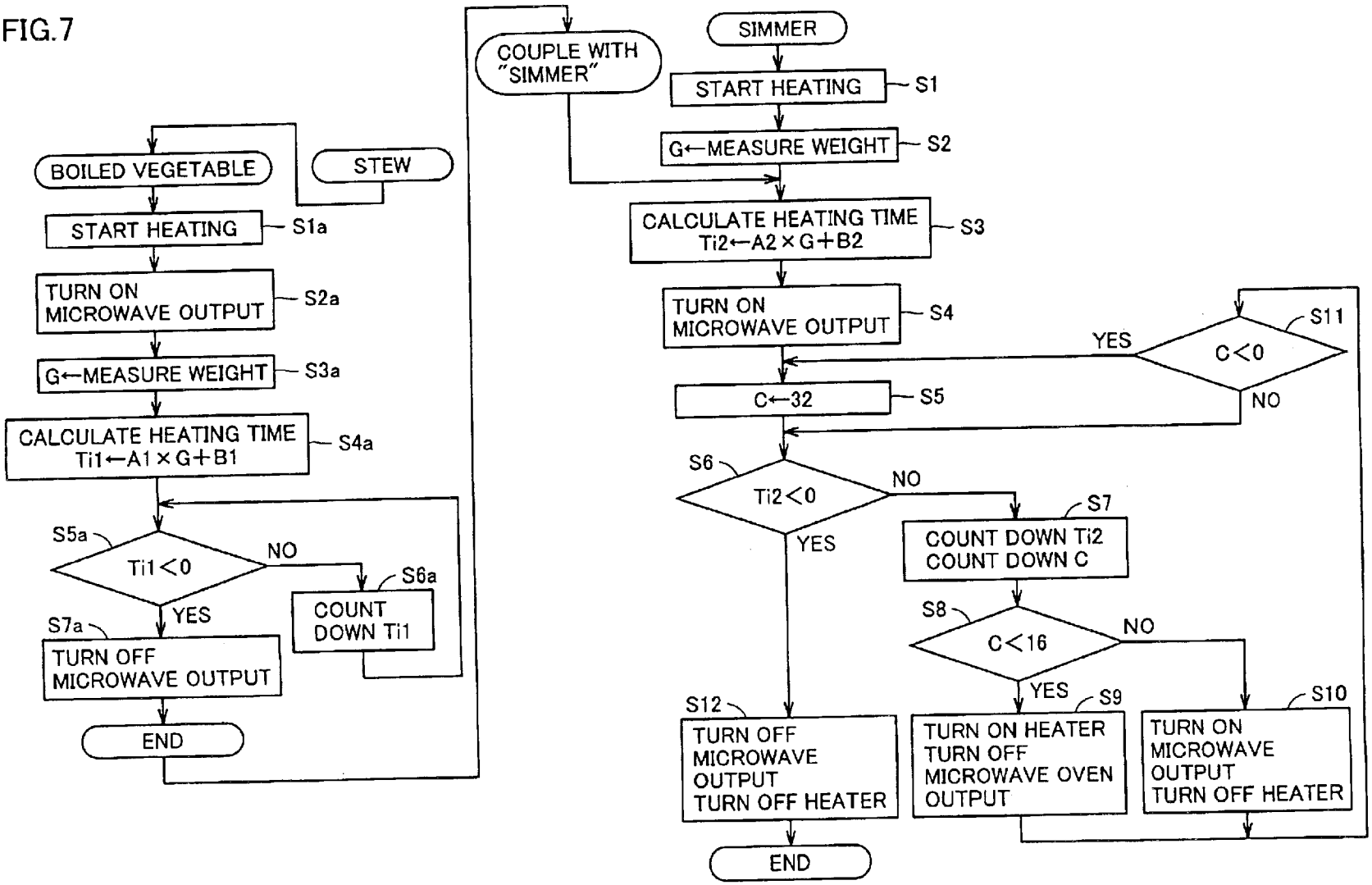
FIG. 7 is a flow chart representing combination of the heating patterns shown in FIGS. 5 and 6.

FIG. 7 is a flow chart representing a combination of heating patterns shown in FIGS. 5 and 6. FIG. 7 shows, as an example, a flow chart for heating control for heating and cooking for the standard recipe name HN "stew".

In operation, the user designates the standard recipe name HN "stew" by operating input unit 15 of microwave oven 1 and instructs start of heating and cooking. Then, the corresponding heating pattern code HPC is read from heating block data group 111, and based on the read heating pattern code HPC, heating pattern data FLi, mode data MDi and heater down time data HDT are read as needed, based on the data, various data are set in microwave oven 1, and heating and cooking in accordance with the sequence represented by the read heating pattern data FLi starts. Here, such a heating pattern data FLi as shown in FIG. 7 is read.

As can be seen from the flow chart of FIG. 7, the heating pattern data FLi that is a combination of heating pattern data FLi shown in FIGS. 5 and 6 is employed as the sequence for heating and cooking the standard recipe name HN "stew". Therefore, for heating and cooking of the standard recipe name HN "stew", the sequence for "boiled vegetables" shown in FIG. 5 is executed, followed by the sequence of FIG. 6 for simmering to prepare the stew.

Here, in the heating and cooking in accordance with the heating pattern data FLi for boiled vegetables, the weight of the food has been measured (S3*a*). Therefore, in the following sequence of heating and cooking for simmering, measurement of weight of the food (S2) is omitted.

In this manner, the heating pattern data FLi inherent to the type of microwave oven 1 may be used in combination, for forming the heating sequence of the standard recipe.

In the flow charts of FIGS. 5 to 7 described above, values of various variables A1, B1, A2 and B2 for sequence control are inherent to the type of the microwave oven 1.

(Second Embodiment)

In the sequence of heating pattern data FLi for "boiled vegetables" in accordance with the first embodiment described above, optimal heating time (Ti1) is calculated based on the measured weight (G) of the materials. This correspond to a correction based on the basic heating control procedure of microwave oven. Without this correction, it is necessary to always prepare the material by the amount indicated by microwave oven 1 or the amount described in a cook book for the microwave oven 1, and the time of heating and cooking is always the same, not allowing correction for optimal cooking.

Figure 8:
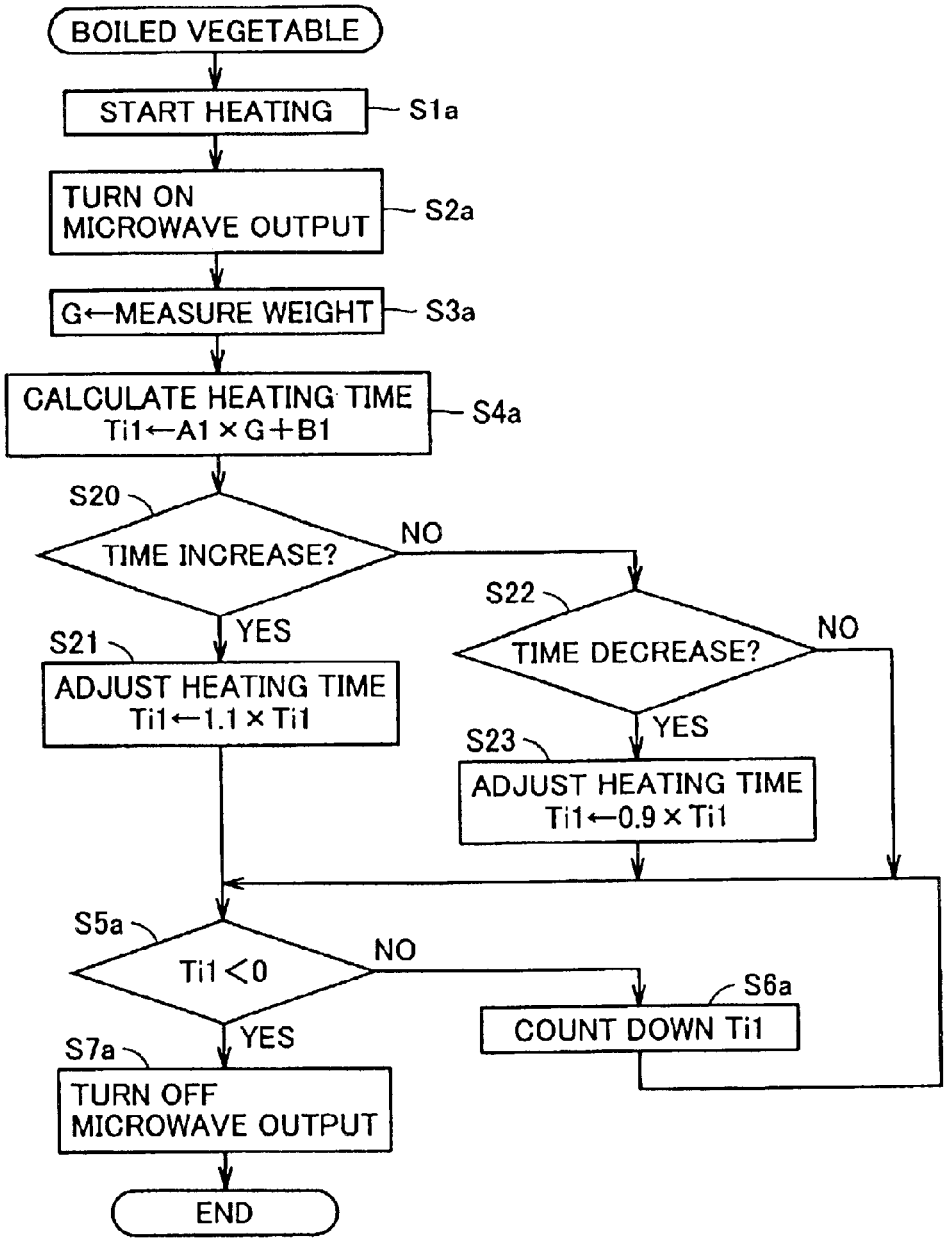
FIG. 8 is a flow chart related to the basic heating pattern of the "boiled vegetables" in accordance with the second embodiment, in which the time of heating and cooking is increased/decreases uniformly.

In the foregoing, the time of heating and cooking is corrected based on the amount of food to be heated and cooked. In this example, the time of heating and cooking is corrected as indicated by the user, and heating and cooking are performed based on the corrected heating time. FIG. 8 is a flow chart in which the time of heating and cooking is increased/decreased uniformly, in the basic heating pattern of "boiled vegetables" in accordance with the second embodiment. In this example, increase/decrease of the heating and cooking time is performed uniformly by 10%, commonly among various types of microwave ovens 1, with regard to the basic heating pattern data FLi.

First, in operation, the user designates "increase boiled vegetable" or "decrease boiled vegetable" as the standard recipe name HN by the operation of input unit 15 of microwave oven 1 to designate start of heating and cooking, then power is fed to magnetron 65, microwave is output, the weight of food is measured, and heating and cooking time (Ti1) corresponding to the basic heating pattern data FLi is calculated using the expression (A1×G+B1) for "boiled vegetables" only (S1*a* to S4*a*).

Thereafter, microcomputer 10 calculates "1.1×Ti1" when the key word "increase time" is included in the designated standard recipe name HN, calculates "0.9×Ti1" when the key word "decrease time" is included, and the results of calculation is finally determined as the heating and cooking time data Ti1 (S20 to S23).

Thereafter, in the similar manner as in FIG. 5, variable Ti1 representing the heating and cooking time is counted down while heating and cooking proceeds, and when the condition Ti1<0 is attained, the microwave output from magnetron 65 is turned OFF and the heating and cooking are terminated (S5*a* to S7*a*).

In the flow chart of FIG. 8 described above, the heating and cooking time data Ti1 is increased/decreases by a uniformly set value (10%) among different types of microwave ovens 1. Alternatively, the heating and cooking time data Ti1 of the basic heating pattern data FLi may be corrected by using an arbitrary coefficient. The arbitrary coefficient is set independently for each type of microwave oven 1. The arbitrary coefficient may be made different for each recipe name heated and cooked by microwave oven 1.

Figure 9:
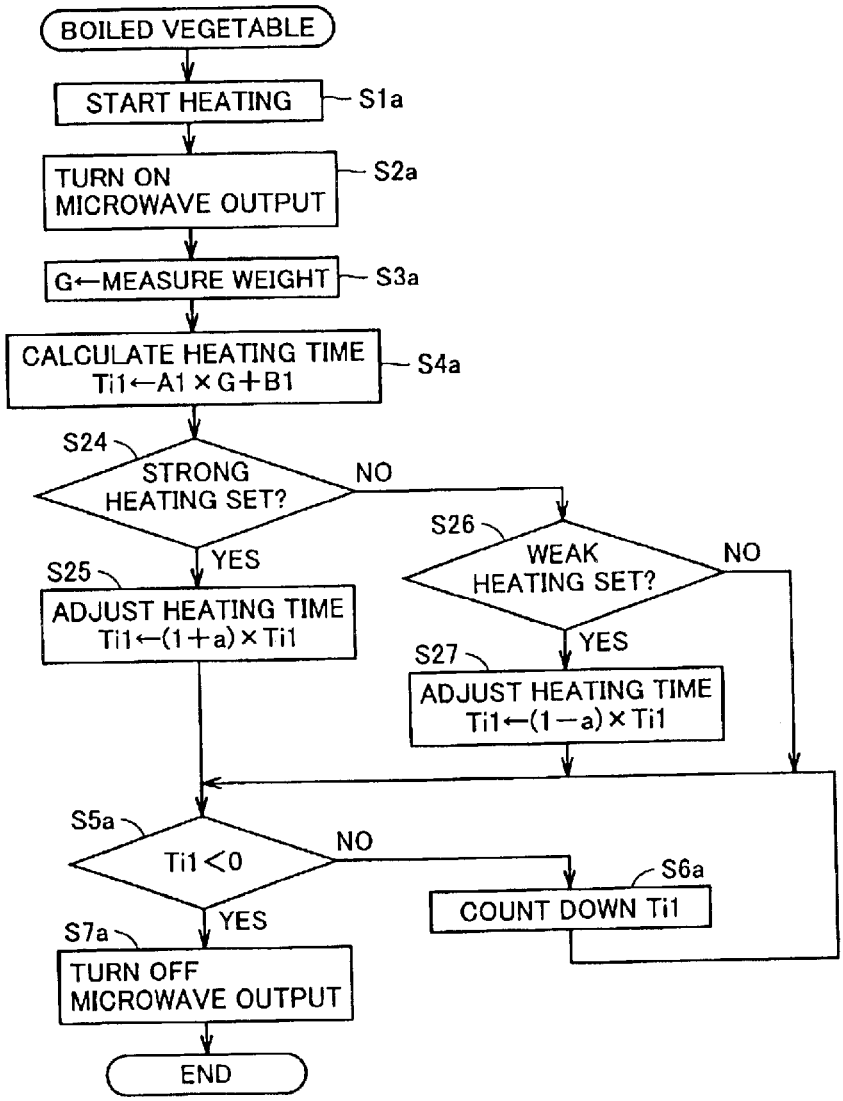
FIG. 9 is a flow chart related to a basic heating pattern data FLi of the standard recipe name HN "boiled vegetables" in accordance with the second embodiment, in which the time of heating and cooking is corrected in consideration of key words such as "high" and "low".

FIG. 9 is a flow chart in which the heating and cooking time is corrected considering the key words such as "high" and "low" in the basic heating pattern data for the standard recipe name HN "boiled vegetables" in accordance with the second embodiment.

In operation, when the user designates the standard recipe name HN "boiled vegetables high" or "boiled vegetables low" by operating input unit 15 of microwave oven 1 and instruct start of heating and cooking, power is fed to magnetron 65, the weight of the food is measured, and the measured weight value (G) is input to the expression for "boiled vegetables". Thus, the heating and cooking time (Ti1) corresponding to the basic heating pattern data FL1 is calculated (S1*a* to S4*a*).

Thereafter, when the standard recipe name HN designated through input unit 15 includes the key word "high setting", calculation of "(1+a)×Ti1" is performed, and when it includes the key word "low setting", "(1−a)×Ti1" is calculated, and the result of calculation is set as the final heating and cooking time data Ti1 (S24 to S27).

Thereafter, heating and cooking proceeds while the heating and cooking time data Ti1 is counted down in the manner as described above, and when the condition Ti1<0 is attained, the output of microwave is turned OFF, and heating and cooking are terminated.

As shown in FIG. 9, the heating output can be controlled to be higher or lower, by correcting the heating and cooking time data Ti1.

(Third Embodiment)

Figure 10:
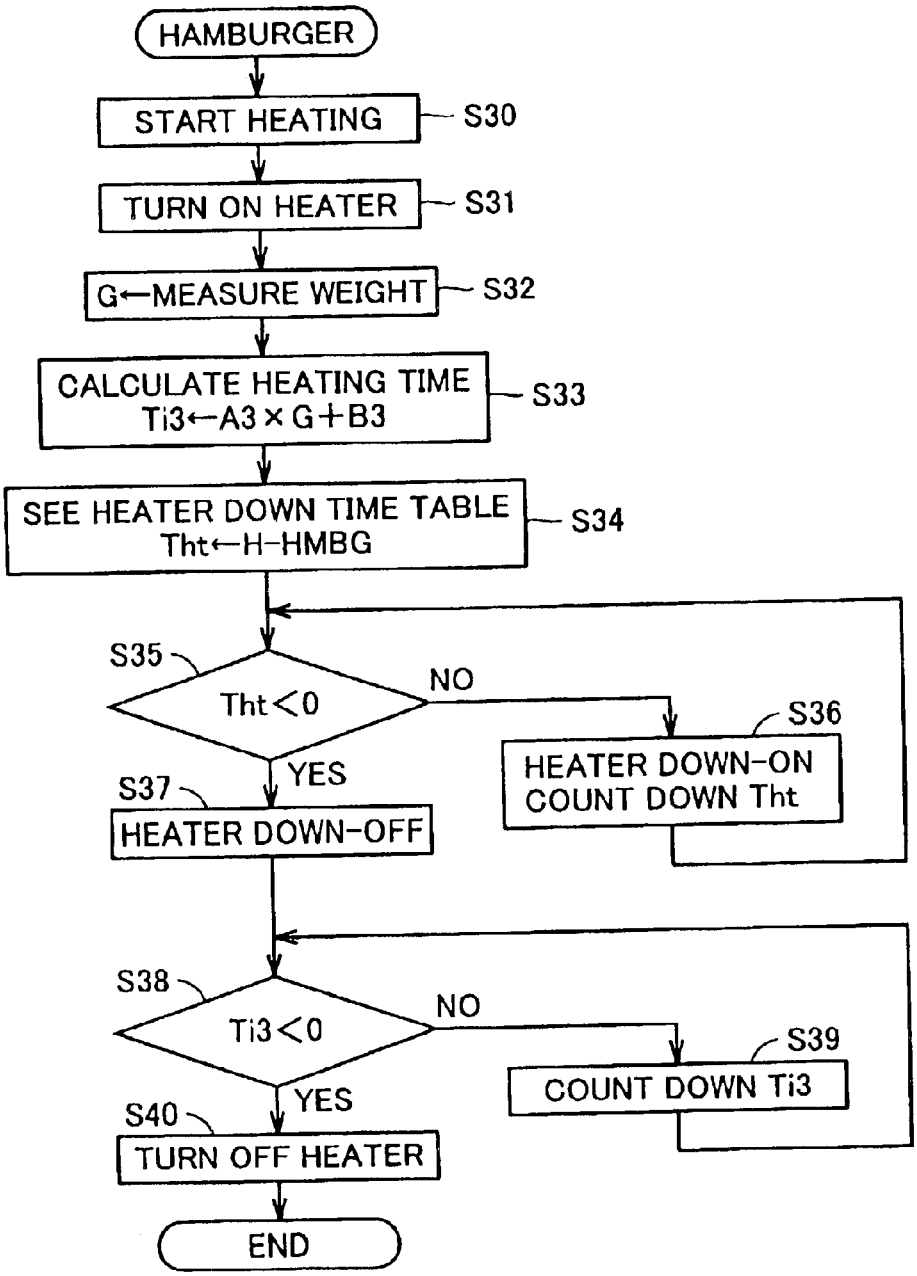
FIG. 10 is a flow chart when heating and cooking are performed with the standard recipe name HN "hamburger" designated, in a third embodiment.

FIG. 10 represents a process flow chart when heating and cooking is performed with the standard recipe name HN "hamburger" is designated, in accordance with the third embodiment.

In operation, the user designates the standard recipe name HN "hamburger" by operating input unit 15 of microwave oven 1 to instruct start of heating and cooking. Then, based on the corresponding heating pattern code HPC, the corresponding heating pattern data FLi, heating mode data MDi and heater down time data HDT are read as needed, and the read data are set. Further, the sequence of the heating operation shown in FIG. 10 in accordance with the corresponding heating pattern data FLi starts under the control of microcomputer 10.

First, power is fed to heater 64 and heating operation starts. Thereafter, the weight of the food is measured, the measured weight is set as variable G, and thereafter, using variable G, the heating and cooking time data is calculated in accordance with "A3×G+B3", which data is set as variable Ti3 (S30 to S33).

After the heating and cooking time data Ti3 is calculated in this manner, heater 64 is moved downward toward the food in the chamber for better finish. Heater 64 is moved downward for a prescribed time period, and fixed at an appropriate position for heating and cooking.

In order to move downward the heater 64 to the appropriate position, the heater down time table 114 of FIG. 4A or 4B is referred to, and the heater down time data HDT corresponding to the standard recipe name HN ("hamburger") denoted by the arrow B is found. More specifically, when microwave oven 1 is of the type A and the standard recipe name HN in table 114 of FIG. 4A is "hamburger", the heater position code HLC specified by the corresponding heating pattern code HPC is "H-HMBG" denoted by the arrow B of FIG. 4A, and therefore the corresponding heater down time data HDT (47 unit) (where 1 unit is, for example, 20 msec) is read. When microwave oven 1 is of the type B, the heater down time data HDT (99 unit) is read in the similar manner from table 114 of FIG. 4B. Then, the thus read data is set as variable Tht (S34).

Thereafter, a motor for moving heater 64 downward, not shown, is driven by means of a relay or the like 62, so that heater 64 is moved downward with the variable Tht being counted down. When "Tht<0" is attained, movement of heater 64 is stopped, and heater 64 is fixed at an appropriate position (S35 to S37).

Thereafter, heating and cooking using heater 64 is performed while heating and cooking time data Ti3 is counted down. When "Ti3<0" is attained, the output of heater 64 is turned off, and the series of heating and cooking are terminated (S38 to S40).

As the movable heater 64 is provided in the chamber of microwave oven 1 and the amount of movement of movable heater 64 is determined not by a physical amount such as time but by the heater position code HLC that is common among various types of microwave ovens 1 and designated by heating pattern code HPC, the heater position code HLC for the same standard recipe name HN can be shared among different types of microwave ovens 1.

(Fourth Embodiment)

The procedure of cooking by a private microwave oven 1 using cooking information publicly available through the Internet 5 in the host computer 4 as a home page server will be described in the following.

Figure 12:
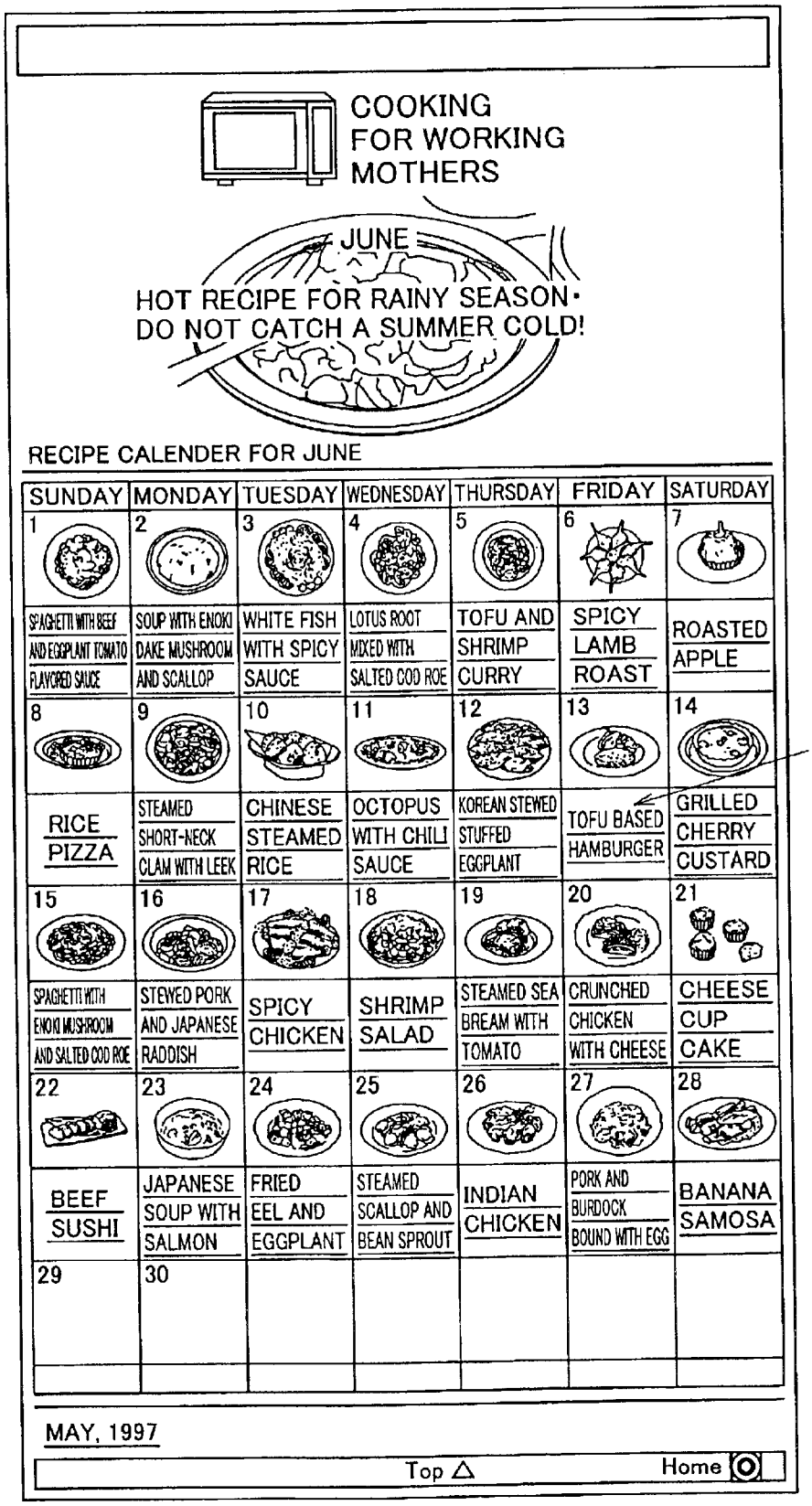
FIG. 12 shows an example of a home page screen displayed in accordance with the home page storing unit 421 of the host computer 4 shown in FIG. 1.
Figure 13:
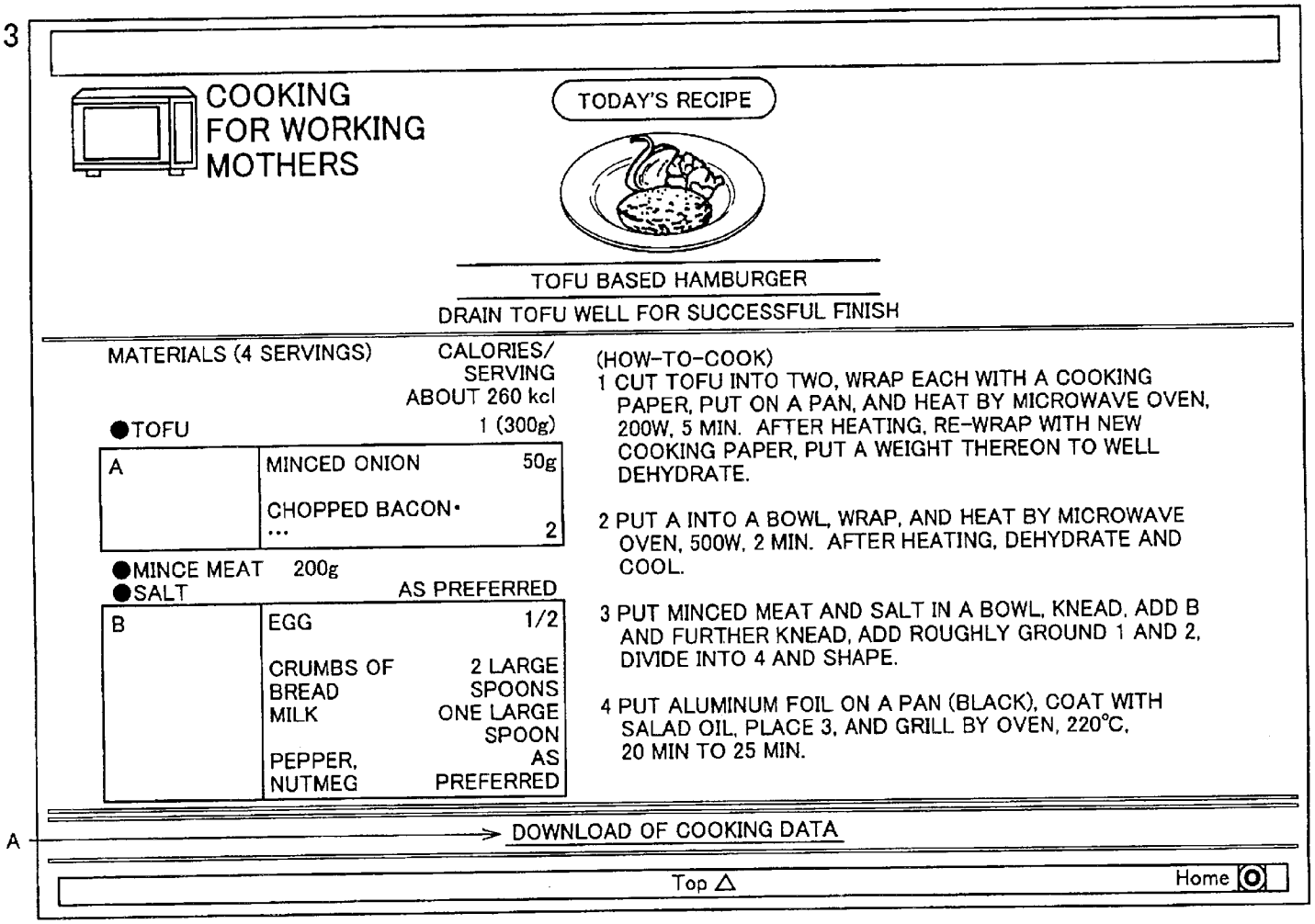
FIG. 13 shows an example of a home page screen displayed in accordance with the home page storing unit 421 of the host computer 4 shown in FIG. 1.

FIGS. 11, 12 and 13 represent examples of home page screen images, displayed in accordance with the home page information stored in the home page storing unit 421 of host computer 4 of FIG. 1. FIGS. 11, 12 and 13 represent examples of home page screen images provided by the applicant on the Internet. When a user operates personal computer 2 and accesses a prescribed address corresponding to the host computer 4 through the Internet 5, the home page display of FIG. 11 appears on the output unit 23 of personal computer 2. When the user clicks, by the input unit 24, an item ("microwave oven") indicated by an arrow A on the home page screen, the home page screen of FIG. 12 appears. The home page screen of FIG. 12 provides daily menu of June, in the form of a calendar. Here, a home page screen having the title of "menu calendar of June" is shown as an example. By designating the preceding or succeeding screen images, the user can browse monthly menu calendar of one year, for example, on the home page.

When the user designates a cooking recipe represented by the arrow A (which recipe represents "tofu-based hamburger") on the home page screen of FIG. 12, the home page screen of FIG. 13 appears, showing a video image of the finished cooking recipe ("tofu-based hamburger"), information of materials and information of how-to-cook.

Though only an example of the home page screen is shown in FIG. 13, home page information of the home page screen image of FIG. 12 described above for each recipe of one year, as presented on the home page screen of FIG. 12, are prepared in advance in the home page storing unit 421.

When the user designates and clicks the item ("download of cooking data") denoted by the arrow A on the home page screen of FIG. 13, the data to be displayed to the user through the microwave oven 1 and the heating data used for heating and cooking by the heating unit 10B of the microwave oven 1 related to the cooking recipe ("tofu-based hamburger") shown in FIG. 13 are down-loaded from host computer 4 through the Internet 5 to the personal computer 2, in response.

It is noted that a dedicated program PRO to enable the function corresponding to the click of the item denoted by the arrow A of FIG. 13 is installed in advance in memory 21 of personal computer 2.

Figures 14A, 14B:
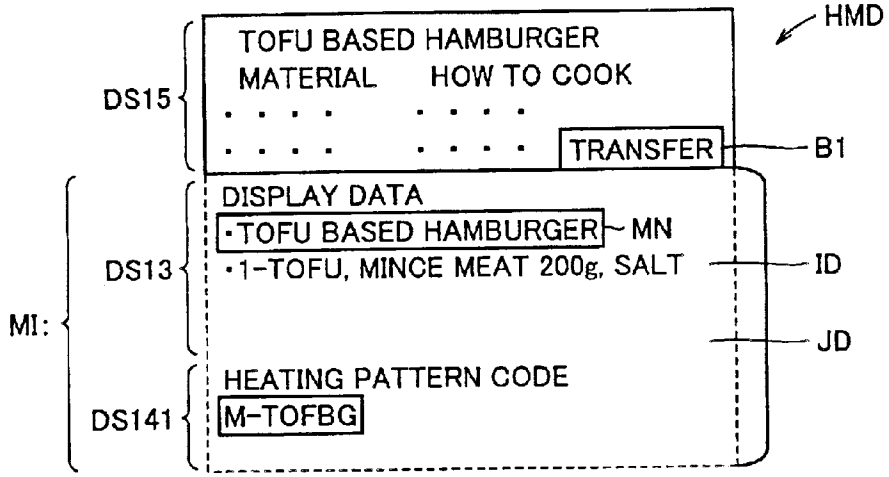
FIGS. 14A and 14B represent home page information including recipe information MI of each of the recipes prepared by host computer 4.

FIGS. 14A and 14B represent home page information including the recipe information of each recipe prepared by host computer 4. The home page information HMD shown in the figure corresponds to the home page screen of FIG. 13, and includes image display data DS15 to be displayed on the home page screen to form the home page screen image, display data DS13 to be displayed on microwave oven 1, and recipe information MI consisting of heating pattern code DS141 for controlling the heating operation of microwave oven 1.

Image display data DS15 is the data to provide the image to be displayed to the user on the home page screen of FIG. 13, and the item ("download of cooking data") denoted by the arrow A corresponds to a transfer button B1 of data DS15 of FIG. 14A.

Therefore, when the item ("download of cooking data") denoted by the arrow A of FIG. 13 is denoted and clicked by the user, transfer button B1 of FIG. 14A is clicked, and the processing unit 41 of host computer 4 downloads recipe information MI including the corresponding display data DS13 and heating data DS14 to the personal computer 2 through communication unit 45 and the Internet 5.

The display data DS13 includes the recipe name MN of the corresponding recipe, material data ID representing necessary materials, and how-to-cook data JD representing the procedure of cooking. The material data ID and the how-to-cook data JD are prepared in advance in accordance with a prescribed procedure, in host computer 4.

FIG. 14B is a data list that is obtained by converting format of recipe information MI of FIG. 14A. FIG. 14B represents, for each of the plurality of different data constituting recipe information MI, the data contents DC, an address AD and a capacity CA. Each of the display data DS13 and heating pattern code DS141 of FIG. 14A are converted to data in such a format that can be recognized by microcomputer 10 of microwave oven 1 as shown in FIG. 14B, by processing unit 41 of host computer 4, and stored in home page storing unit 421. Data contents DC include data DC11 of data code, last address and type code; DC2 of recipe name and head address of heating data; DC3 of head/last address of display page address information; recipe name MN; heating pattern code DS141; display page address information DC4; and display data DS13.

When the data of FIG. 14B is to be down-loaded to personal computer 2 through the Internet 5, the data is further converted to specific codes by processing unit 41. When the home page information HMD is accessed through the Internet 5, processing unit 41 determines whether there is a download request by a click of transfer button B 1, and when the button is clicked, recipe information MI corresponding to the accessed home page information HMD is down-loaded to personal computer 2.

Figure 15:
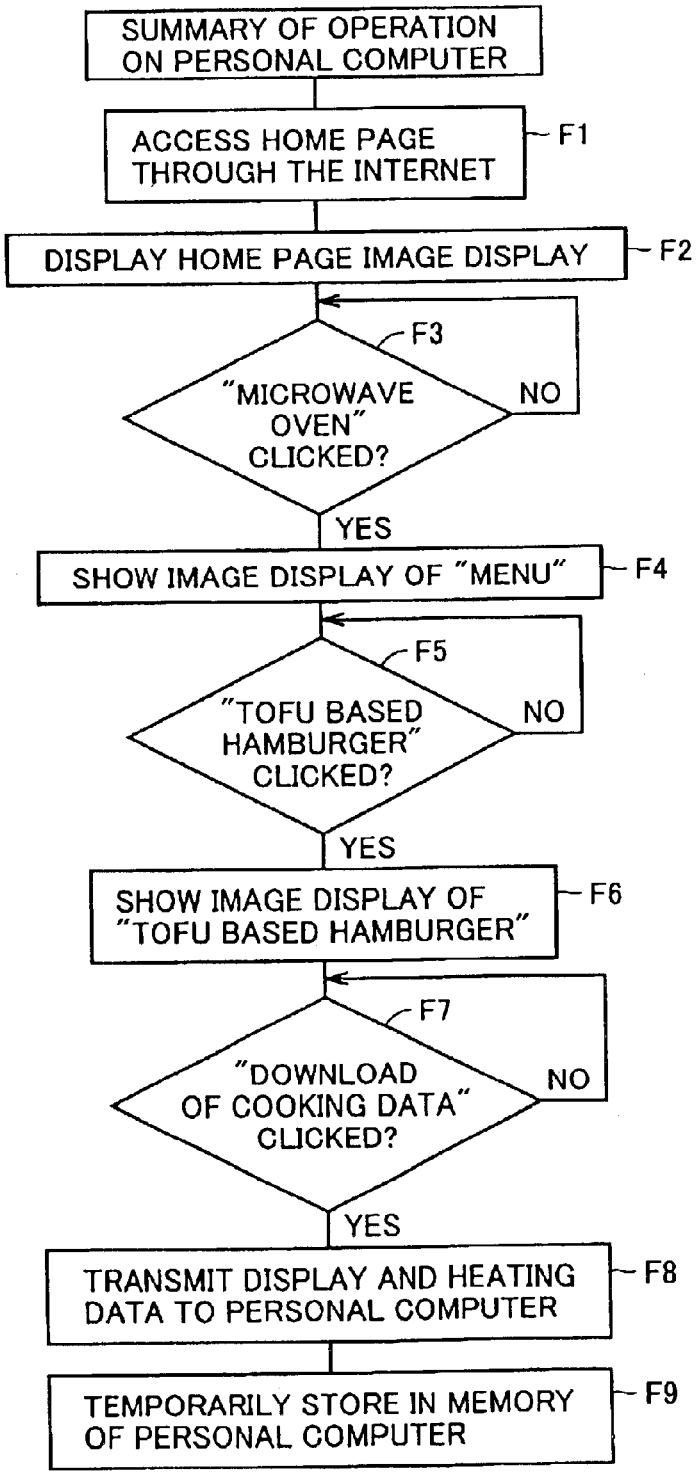
FIG. 15 is a flow chart representing outline of operation related to downloading of recipe information by a personal computer 2 shown in FIG. 1.

FIG. 15 is a flow chart summarizing the operation related to downloading of the recipe information by the personal computer 2 of FIG. 1. Referring to the figure, the private user accesses host computer 4 of the home page through the Internet 5 by operating an input unit 24 of personal computer 2 step (F1 of FIG. 15, hereinafter the step F will be simply denoted by F), so that the data for the home page screen including image display data DS15 of the home page information HMD in the home page storing unit 421 of host computer 4 are transmitted to personal computer 2, and the home page image display of FIG. 11 is displayed on output unit 23 (F2). When the item ("microwave oven") represented by the arrow A on the home page screen of FIG. 11 is clicked by input unit 24, the screen image is switched to the home page screen image of FIG. 4 showing the monthly menu (F3, F4).

When "tofu-based hamburger" denoted by the arrow A is clicked by input unit 24 on the home page screen of FIG. 12, the screen image is switched to the cooking recipe image display of "tofu-based hamburger" of FIG. 13 (F5 and F6).

When the item "download of cooking data" designated by the arrow A of FIG. 13 is clicked by the user at input unit 24, the recipe information MI including corresponding display data and heating pattern code DS13 and DS141 of FIGS. 14A and 14B corresponding to home page storing unit 421 of host computer 4 is transmitted to personal computer 2, and temporarily stored in memory 21 (F8, F9).

The function corresponding to the operation of transfer button B1 on the home page screen becomes effective when a dedicated program PRO is installed to memory 21 of personal computer 2 from an associated home page of the purchased relay box 3. The dedicated program PRO automatically designates the recipe information MI to be downloaded and automatically designates the destination of storage of the downloaded recipe information MI, so that by a simple click of transfer button B1, the function of downloading recipe information M1 and the function of transmitting recipe information MI temporarily stored in personal computer 2 to relay box 3 are attained.

General method of communication must be established between personal computer 2 and microwave oven 1. Therefore, in the present embodiment, RS232-C standard, established for stable bi-directional communication, is adopted.

Figure 16:
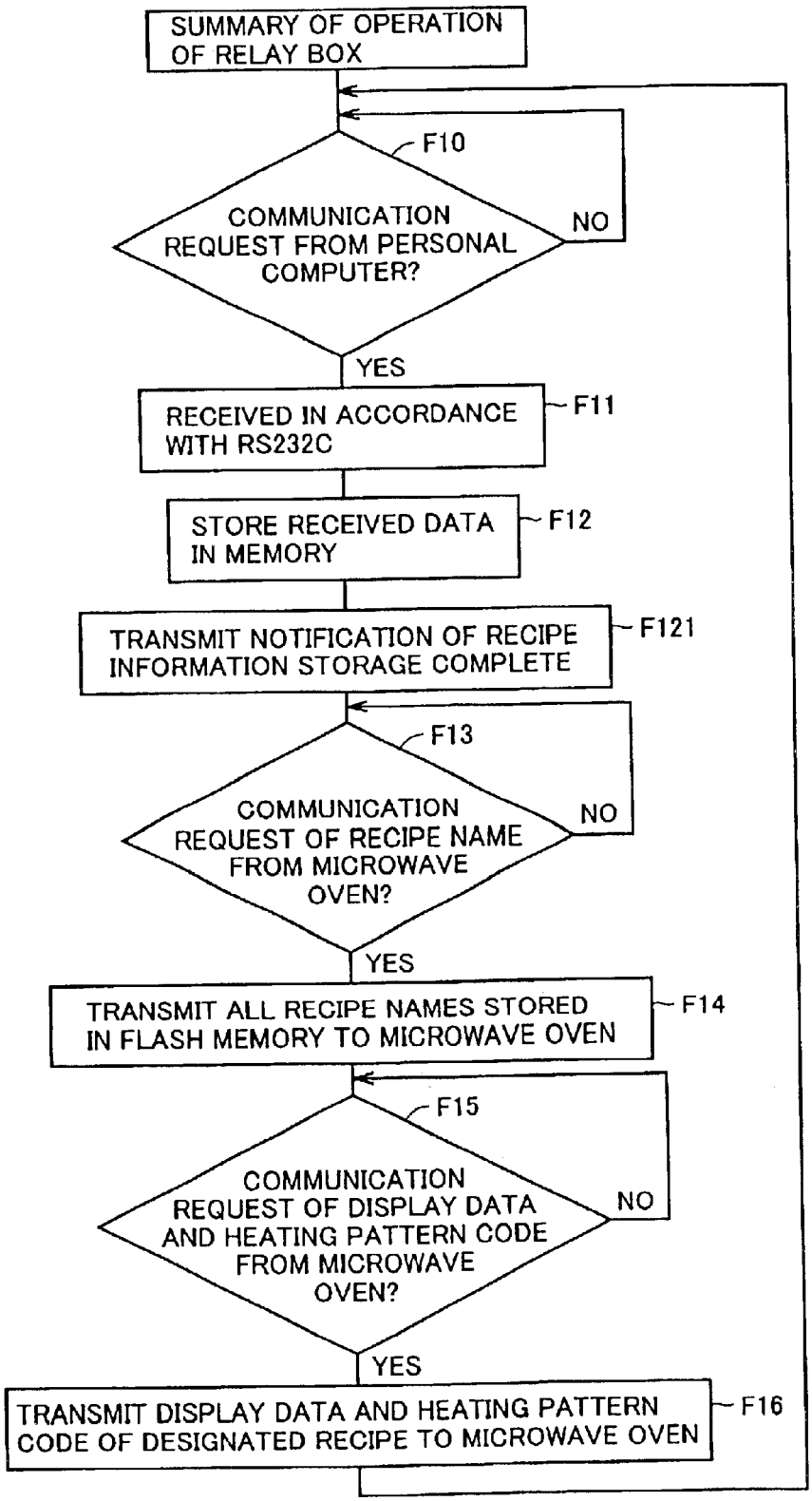
FIG. 16 is a flow chart schematically representing an operation of a relay box 3 shown in FIG. 1.

FIG. 16 is a flow chart schematically showing the operation of relay box 3.

When there is a download request of recipe information MI generated by personal computer 2 in the above described manner, a communication request is transmitted from personal computer 2 to relay box 3, the recipe information MI including display data and heating pattern code DS13 and DS141 are transmitted in accordance with RS-232C standard, and the information is stored in memory 31 through transmitting/receiving unit 32 and microcomputer 30 (F10 to F12 of FIG. 16). Thereafter, microcomputer 30 transmits a notification of recipe information storage complete, notifying completion of storage of the recipe information, to the microwave oven 1 (F121).

It is possible to store recipe information MI of a plurality of cooking recipes in memory 31.

Upon request of microcomputer 10 of microwave oven 1, microcomputer 30 of relay box 3 transmits all the recipe names MN stored in memory 31 to microcomputer 10 of microwave oven 1 through a cable 9 (F13 and F14).

Thereafter, in accordance with an instruction from microcomputer 10 of microwave oven 1, microcomputer 30 in relay box 3 transmits, among at least one recipe information MI stored in memory 31, the display data and heating pattern code DS13 and DS141 corresponding to the designated recipe name MN to microcomputer 10 of microwave oven 1 (F16).

Figure 17:
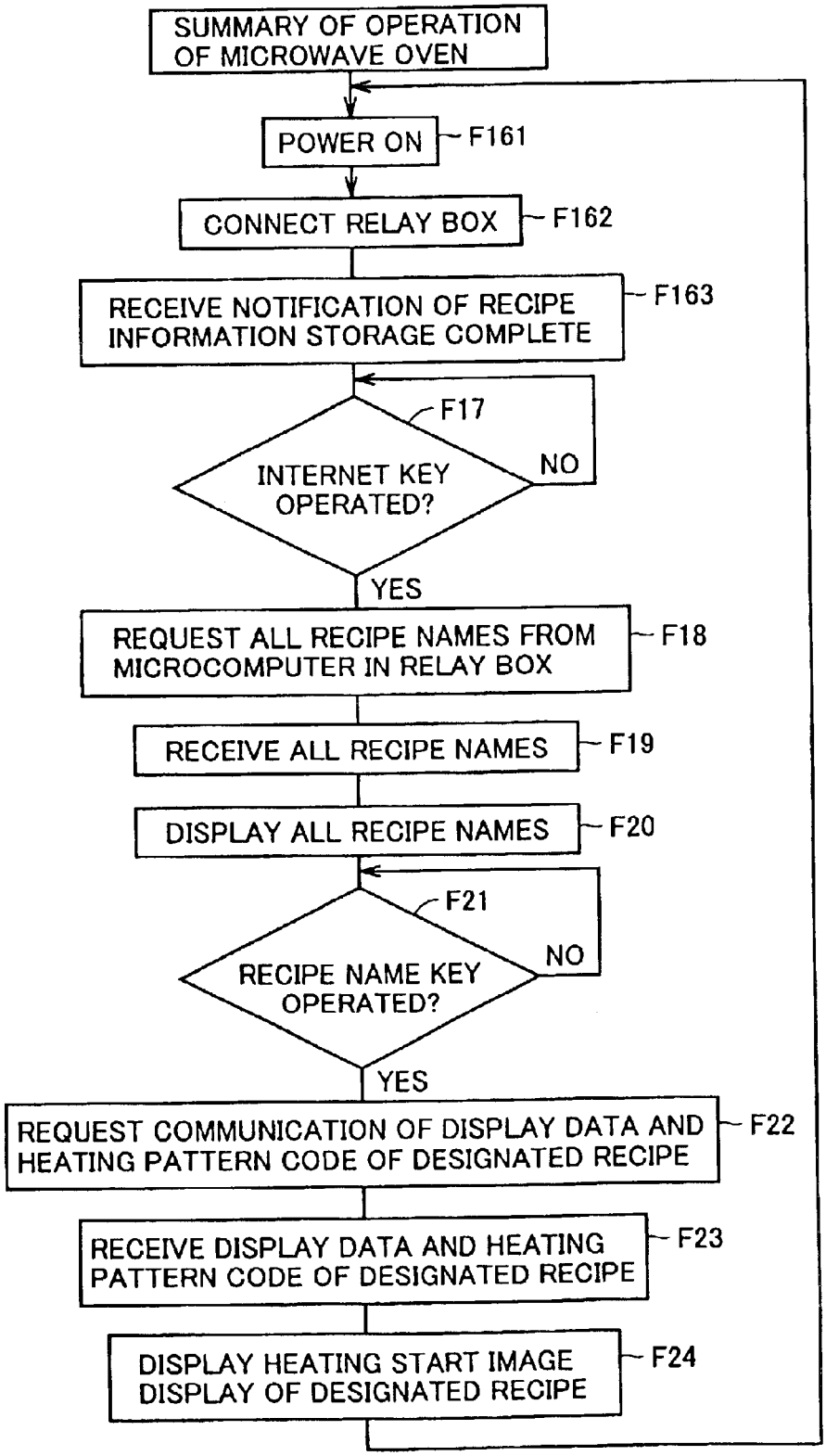
FIG. 17 is a flow chart schematically representing an operation of the microwave oven shown in FIG. 1.

FIG. 17 is a flow chart schematically showing the operation of the microwave oven shown in FIG. 1. FIGS. 18A to 18D are illustrations of the images displayed on the microwave oven, in the flow chart of FIG. 14. FIG. 19 represents an example of contents stored in memory 31 of the relay box of the flow chart of FIG. 17.

Figure 18A:
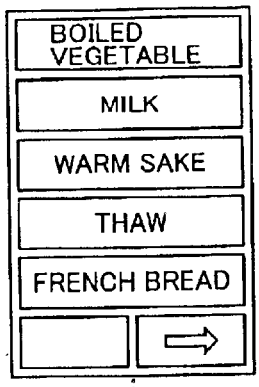
FIGS. 18A to 18D represent examples of images displayed on the side of the microwave oven, in accordance with the flow chart of FIG. 17.
Figure 18B:
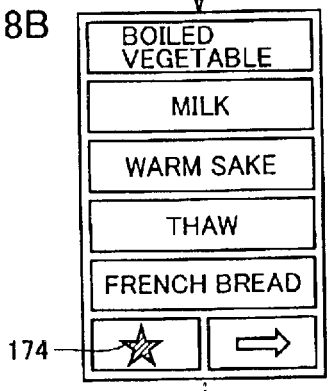
Figure 18C:
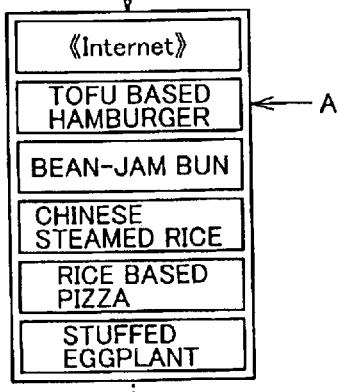
Figure 18D:
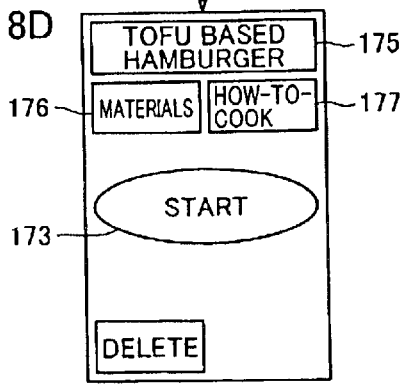

FIGS. 18A to 18D represent examples of display images of a touch panel which is an integration of input unit 15 and LCD panel 13 of FIG. 2. In the initial image of FIG. 18A, standard recipe names HN that can be heated and cooked by microwave oven 1 are listed. Referring to the image of FIG. 18B, on microwave oven 1, an Internet key 174 is displayed and operated to receive and display the recipe information MI from the host computer 4 of the home page through the Internet 5, personal computer 2 and relay box 3. When Internet key 174 is operated, the image of FIG. 18C appears. In FIG. 18B, recipe names MN received from relay box in accordance with the procedure of FIG. 17 are listed. FIG. 18D shows a recipe name display area 175 displaying the received recipe names MN, material data ID and how-to-cook data JD, material display area 176 and how-to-cook display area 177, as well as a start key 173 which is operated to start heating and cooking by microwave oven 1, in accordance with the received heating pattern data DC141.

It is possible to store at most five pieces of recipe information MI, for example, in memory 31. Five pieces of recipe information MI received from the host computer 4 of the home page through the Internet 5 and personal computer 2 are stored in advance in the example of FIG. 19. Each recipe information MI includes recipe name MN, material data ID, how-to-cook data JD and heating pattern code DS141.

The operation of microwave oven 1 shown in FIG. 17 will be described with reference to FIGS. 18A to 18D and FIG. 19. It is assumed that the contents of FIG. 19 are already stored in memory 31 of relay box 3.

First, a power switch, not shown, related to power supply circuit 16 of microwave oven 1 is turned on by the user, so that power is supplied to microwave oven 1, and the display of FIG. 18A is given on LCD panel 13 (F161).

When the user connects the connector CN shown in FIG. 1 to an input/output terminal, not shown, of microwave oven 1, relay box 3 is connected to microwave oven 1. At this time, as one or more pieces of recipe information MI such as shown in FIG. 19 is stored in memory 31 as described above, the notification of recipe information storage complete is transmitted from microcomputer 30 of relay box 3 to microcomputer 10 of microwave oven 1 through cable 9. When the notification of recipe information storage complete is received by microcomputer 10, the manner of display is changed as shown in FIG. 18B, with the internet key 174 highlighted, for example. It is possible for the user to know that the recipe information MI has already been stored in memory 31 of relay box 3, by the change in the manner of display of internet key 174 (F163).

Confirming the manner of display of internet key 174 of FIG. 18B representing that the recipe information MI has already been stored in memory 31 of relay box 3, the user operates internet key 174, and microcomputer 10 request all the recipe names MN to microcomputer 30 of relay box 3 through the cable 9 (F17, F18).

In response to the request for all recipe names MN, microcomputer 30 reads all the recipe names MN from memory 31 of FIG. 19, and transmits the recipe names to microwave oven 1 through the cable 9. Therefore, microcomputer 10 of microwave oven 1 receives all the recipe names MN, and displays the names on LCD panel 13 as shown in FIG. 18C (F19 to F20).

Among the all recipe names MN displayed as shown in FIG. 18C, when the recipe "tofu-based hamburger" denoted by the arrow A, for example, is operated (touched) and designated by the user, microcomputer 10 request display data DS13 and heating pattern code DS14 of the designated recipe name MN("tofu-based hamburger") to relay box 3 through cable 9 (F21 and F22).

In response to the request of data corresponding to recipe name MN ("tofu-based hamburger") from microwave oven 1, microcomputer 30 of relay box 3 reads and transmits display data DS13 (recipe name MN3, material data ID and how-to-cook data JD) and heating pattern code DS141 corresponding to the recipe name MN ("tofu-based hamburger") from memory 31, so that microcomputer 10 of microwave oven 1 receives the display data DS13 and heating pattern code DS141 and temporarily writes and stores in internal memory (F22 and F23).

Microcomputer 10 provides the display of FIG. 18D on LCD panel 13 so as to urge the instruction input of the user to start heating and cooking of the designated recipe (F24). When start key 173 of FIG. 18D is operated, heating and cooking by heating unit 10B starts, in accordance with the heating pattern code DS141. As shown in FIG. 18D, recipe name MN, material data ID and how-to-cook data JD of the received display data DS13 are displayed in recipe name display area 175, material display area 176 and how-to-cook display area 177, respectively.

The recipe information MI supplied from host computer 4 includes heating pattern code DS141 as shown in FIGS. 14A and 14B. Upon reception of heating pattern code DS141, microwave oven 1 reads as needed the heating pattern data FLi, heating mode data MDi and heater position data HDT designated by the received heating pattern code DS141, from memory 11A, and heating operation in accordance with the data including the read heating pattern data FLi is performed.

FIGS. 20A and 20B represent another example of recipe information MI for respective recipes prepared on the side of host computer 4, and information set in microwave oven 1. When the recipe name MN is "sponge cake" and recipe information MI shown in FIG. 20A having heating pattern code DS141 of "M-SPONG" is downloaded, the following heating operation takes place in microwave oven 1.

More specifically, microwave oven 1 receives the heating pattern code DS141 applied from relay box 3, reads the heating pattern data FLi designated by the received heating pattern code DS141 from pattern data group 112, reads the heating mode data MDi designated by the heating pattern code DS141 (M-SPONG) from heating mode data group 113, and using the read heating mode data MDi and heating pattern data FLi, heating and cooking are performed. When the microwave oven 1 is of the type A, data such as heating mode: oven with upper and lower heaters, oven temperature attained by heater 64: 170° C. and heating time (seconds): Aa×G+Ba are obtained as data for heating and cooking a sponge cake as shown in FIG. 20B. Based on the thus obtained data and the sequence in accordance with the read heating pattern data FLi, optimal heating and cooking are performed. When the microwave oven 1 is of the type B, data such as heating mode: microwave and upper and lower heaters, oven temperature attained by heater 64: 160° C., heating time (seconds): Ab×G+Bb, and microwave output level 700W are obtained as data for heating and cooking a sponge cake as shown in FIG. 20B. Based on the thus obtained data and the sequence in accordance with the read heating pattern data FLi, optimal heating and cooking are performed in microwave oven 1.

FIGS. 21A and 21B represent further example of recipe information MI for each of the recipes prepared by host computer 4 and information set in microwave oven 1. Referring to FIG. 21A, the recipe information MI downloaded from host computer 4 corresponds to the recipe name MN of "foil and grill", and "M-HOIR: H-HOIR" is set as heating pattern code DS141.

When heating and cooking are performed in accordance with the heating pattern code DS141 of recipe information MI shown in FIG. 21A, by microwave oven 1, data corresponding to the heating pattern code DS141 are read in the similar manner as described above, from memory 11A. When the microwave oven 1 is of the type A, for example, corresponding heater pattern data FLi is read from pattern data group 112 based on heating pattern code (M-HOIR), and the corresponding heating mode data MDi is read from heating mode data group 113. Further, based on the heating pattern code (H-HOIR), the heater down time HDT represented by corresponding heater position code HLC is read from heater down time table 114 (see FIG. 4A).

Accordingly, for microwave oven 1 of the type A, "heating mode: toaster, heating time (seconds): Aa×G+Ba, heater down time: 49 units" are obtained as data for heating and cooking as shown in FIG. 21B. Based on the data and the sequence of the read heating pattern data FLi, the position of heater 64 for optimal heating is ensured in microwave oven 1 for "foil and grill", and heating and cooking are performed.

In the similar manner, when the microwave oven 1 is of the type B, "heating mode: toaster, heating time: Ab×G+Bb, heater down time: 90 units" are obtained as data for heating and cooking, and based on the data and the sequence of read heating pattern FLi, optimal heating and position of heater 64 are ensured in microwave oven 1 and heating and cooking are performed.

(Fifth Embodiment)

In the present embodiment, when a new heating pattern is developed after shipment of microwave oven 1, the data of heating pattern can be downloaded and stored in memory 11B of microwave oven 1, through the Internet 5 from host computer 4 to personal computer 2 or relay box 3.

The basic concept of the heating pattern method is that optimal heating control data for each type of microwave oven 1, that is, heating pattern data FLi, heating mode data MDi and heater down time data HDT are provided, which are designated by a heating pattern code shared among different types of microwave ovens 1. Therefore, the heating pattern data FLi, heating mode data MDi and heater down time data HDT specified by the heating pattern code DS141 downloaded through the Internet 5 represent type-specific heating information. By additionally storing the new heating pattern code DS141 downloaded from the home page of host computer 4 in memory 11B of microwave oven 1, it becomes possible to heat and cook the new recipe using the stored heating pattern code DS141, in addition to the standard recipes in microwave oven 1.

The data is stored in memory 11B in the following manner. When the user requests downloading of recipe information MI corresponding to the desired recipe by confirming the images on the screen shown in FIGS. 12 and 13, the recipe information MI of the desired recipe is stored in accordance with the format shown in FIG. 19, in memory 31 of relay box 3. The user confirms by the list of recipe names MN display as FIG. 18C that the recipe information MI of the desired recipe is stored in memory 31, and operates input unit 15 to designate desired recipe name MN. Consequently, the designated recipe name MN and the request for the corresponding heating pattern code DS141 are transmitted to relay box 3. Microcomputer 30 of relay box 3 receives the request, reads the requested recipe name MN and the corresponding heating pattern code DS141 from memory 31, and transmits the same to microwave oven 1. Microcomputer 10 of microwave oven 1 receives and writes to memory 11B the requested recipe name MN and the corresponding heating pattern code DS141.

FIGS. 22 and 23 represent memories 11B of microwave ovens 1 of the types A and B, in which new heating pattern codes are registered. As shown in the figures, while heating pattern code HPC is stored in correspondence with the standard recipe name HN, three new recipe names MN represented by the arrow A and associated heating pattern codes DS141 corresponding to these, respectively, are received and stored in memory 11B.

When the desired recipe name HN or MN is designated among the plurality of recipe names stored in memory 11A or 11B through an operation of input unit 15, corresponding heating pattern code HPC or DS141 is read from memory 11A or 11B, and based on the read heating pattern code, the corresponding heating pattern data FLi, heating mode data MDi (heating time, data of oven temperature attained by heater 64 and so on) and down time data HDT for the heater 64 are determined as necessary. In accordance with the sequence of the determined heating pattern data FLi, heating and cooking are executed in microwave oven 1, and therefore, optimal finish can be ensured for the desired recipe, even when the type differs.

(Sixth Embodiment)

The sixth embodiment of the present invention will be described in the following.

Figure 24:
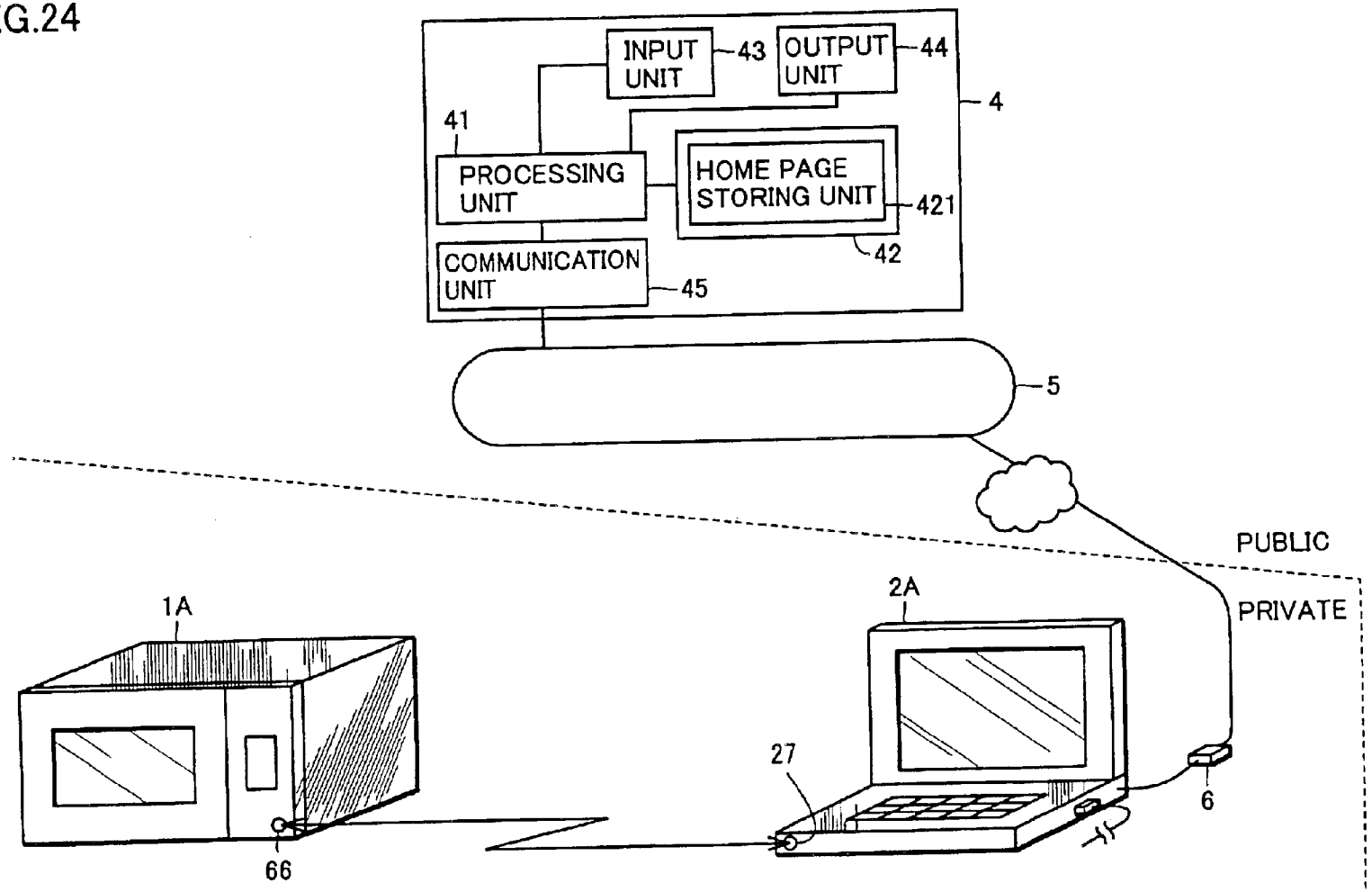
FIG. 24 shows a schematic configuration of the microwave oven system in accordance with a sixth embodiment of the present invention.
Figure 25:
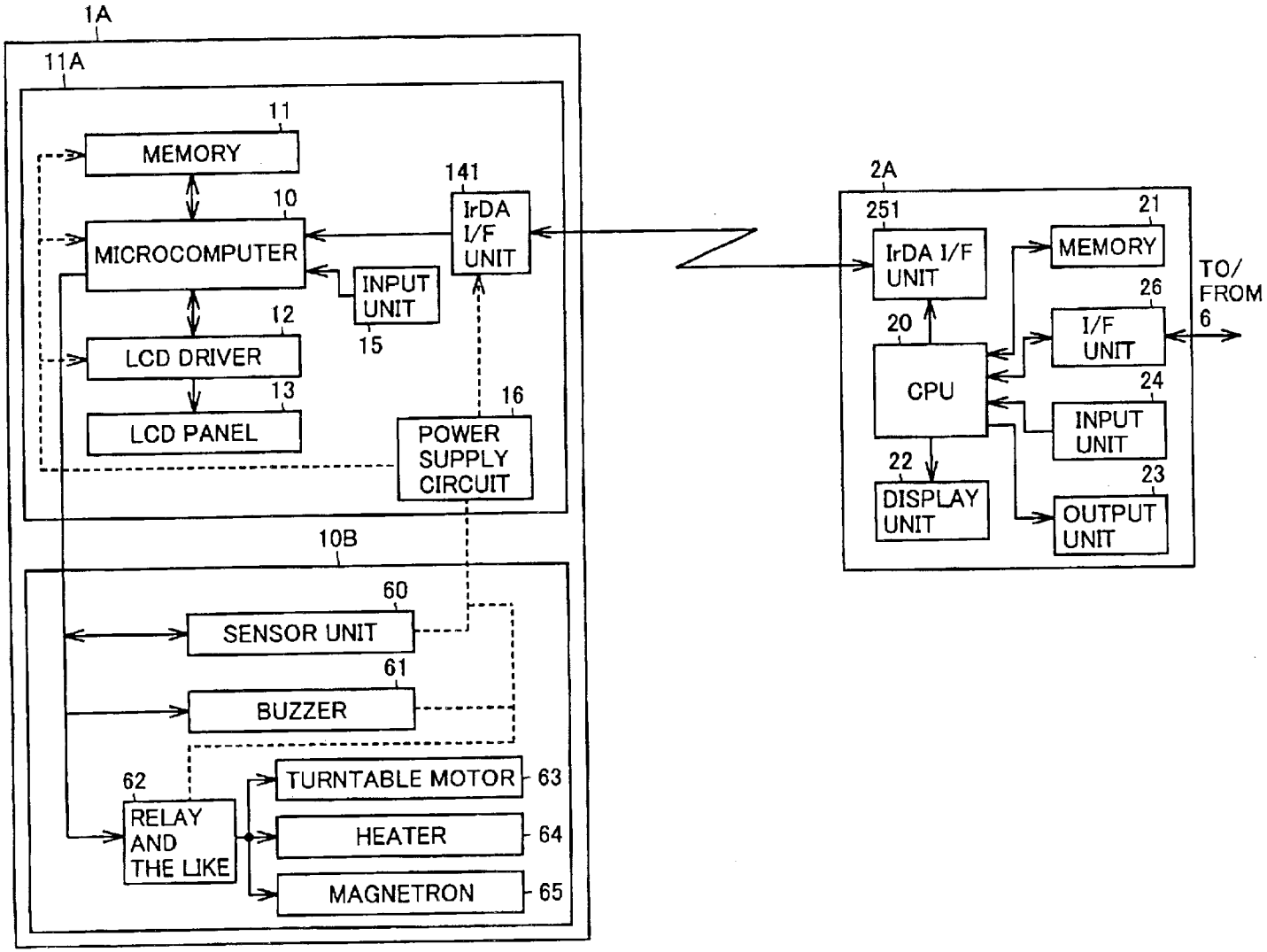
FIG. 25 represents block configurations of microwave oven 1A and a personal computer 2A of FIG. 24.

In the present embodiment, relay box 3 is omitted, and the function of relay box 3 is provided in the personal computer so as to enable direct communication between the microwave oven and the personal computer. FIG. 24 schematically represents the configuration of the microwave oven system in accordance with the sixth embodiment. FIG. 25 shows block configuration of microwave oven 1A shown in FIG. 24 and personal computer 2A.

Referring to FIG. 24, microwave oven 1A and personal computer 2A have infrared receiving/emitting units 66 and 27 for wireless communication in accordance with IrDA (infrared data association) with each other. Microwave oven 1A and personal computer 2A shown in FIG. 24 are different from microwave oven 1 and personal computer 2 shown in FIG. 2, respectively, in that microwave oven 1A is provided with an IrDAI/F unit 141 related to infrared receiving/emitting unit 66 in place of I/F unit 14 of FIG. 2, and that personal computer 2A is provided with an IrDAI/F unit 251 related to infrared receiving/emitting unit 27 in place of RS-232C port 25 shown in FIG. 2. Other structures of microwave oven 1A and personal computer 2A are the same as those of FIG. 2, and therefore, description thereof will not be repeated. As wireless communication using IrDA is performed, the trouble of connecting cables in the microwave oven system can be eliminated, and the system can be installed easily.

In the present embodiment, the function of relay box 3 described in the embodiments above is incorporated in personal computer 2A. Therefore, in this configuration also, the features realized in the embodiments described above can also be attained. Here, detailed description related to the operations of the microwave oven system will not be repeated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven system, comprising:

a communication network;

an information processing apparatus having an output unit, an externally operable input unit, a transmitting/receiving unit transmitting/receiving information through said communication network, and information storage unit for storing various information including information received by said transmitting/receiving unit;

a microwave oven receiving information stored in said information processing apparatus; and a host computer connected to said communication network and having an information storing unit storing home page information corresponding to a home page screen displayed on said output unit; wherein said home page information includes information related to a plurality of recipes; recipe data corresponding to each of said plurality of recipes including a heating control code, said heating control code being a generic code common to a variety of types of microwave ovens for heating and cooking, and a transfer instruction button operated through said input unit for transferring said recipe data through said communication network to said information processing apparatus;

said microwave oven has procedure storing means for storing a plurality of different pieces of procedure information, said pieces of procedure information being the control procedure of heating operation for a type of microwave oven and when a desired recipe is selected from among the plurality of recipes of said home page information, said heating control code for said selected recipe is interpreted by reading one or more pieces of procedure information from the procedure storing means, and said heating operation is performed in accordance with said one or more said pieces of procedure information read from said procedure storing means.

2. The microwave oven system according to claim 1, wherein said microwave oven further has a movable heater; and said plurality of different pieces of procedure information include information designating amount of movement of said heater.

3. The microwave oven system according to claim 1, wherein said microwave oven further has heating control code storing means to which said heating control code is written in advance, corresponding to each of one or more recipes that can be heated and cooked by said microwave oven; and when a prescribed recipe selected from said one or more recipes is to be heated and cooked, said heating operation is executed in accordance with one or more pieces of said procedure information read from said procedure storing means, based on said heating control code corresponding to the prescribed recipe read from said heating control code storing means.

4. The microwave oven system according to claim 3, wherein in said heating control code storing means, said heating control code corresponding to the selected recipe is stored arbitrarily and additionally, in correspondence with the selected recipe.

5. The microwave oven system according to claim 4, wherein said selected recipe is a desired recipe among a plurality of recipes of said home page information.

6. A microwave oven system, comprising:

a communication network;

an information, processing apparatus having an output unit, an externally operable input unit and a transmitting/receiving unit transmitting/receiving information through said communication network;

a microwave oven performing heating operation for heating and cooking;

a relay apparatus having an information storage unit for relaying information transmitted between said microwave oven and said information processing apparatus, having one end connected to said microwave oven and the other end connected to said information processing apparatus; and a host computer connected to said communication network and having an information storing unit storing home page information corresponding to a home page image screen to be displayed on said output unit; wherein said home page information includes information, related to a plurality of recipes, recipe data corresponding to each of said plurality of recipes including a heating control code, said heating control code being a generic code common to a variety of types of said microwave ovens for seating and cooking, and information of a transfer instruction button operated through said input unit for transferring, said recipe data, through said communication network to said information processing apparatus;

said microwave oven has procedure storing means, for storing, a plurality of different pieces of procedure information, said pieces of procedure information being the control procedure of heating operation for a type of said microwave oven;, and when a desired recipe is selected among the plurality of recipes of said home page information, said heating control code for said selected recipe supplied from said information processing apparatus through said relay apparatus is interpreted by reading one or more pieces of procedure information from the procedure storing means, and said heating operation is executed in accordance with one or more pieces of said procedure information read from said procedure storing means.

7. A microwave oven performing a heating operation for heating and cooking, comprising:

code storing means for storing a heating control code, said heating control code being a generic code common to a variety of types of microwave ovens for heating and cooking, corresponding to each of a plurality of recipes; and procedure storing means storing a plurality of different pieces of procedure information, said pieces of procedure information being the control procedure of heating operation for the type of the microwave oven, for, executing said heating operation; wherein upon selection of a recipe from among said plurality of recipes, said heating control code for said selected recipe is interpreted by reading one or more pieces of said procedure information from said procedure storing means, and said heating operation is performed in accordance with said one or more pieces of procedure information read from said procedure storing means.

8. The microwave oven according to claim 7, wherein said plurality of different pieces of procedure information includes one or more pieces of heating sequence information; and said heating sequence information consists of a combination of one or more sequences matching the type of the microwave oven for executing said heating operation.

9. The microwave oven according to claim 8, wherein the combination o:f said one or more sequences indicated by said heating sequence information includes one or more parameters for controlling said sequence, and values of said one or more parameters are variably adjusted in accordance with an instructed arbitrary amount.

10. The microwave oven according to claim 9, wherein said one or more parameters include a period parameter representing the period of said heating operation.

11. The microwave oven according to claim 9, wherein said arbitrary amount is generic for a variety of types of said microwave ovens.

12. The microwave oven according to claim 9, wherein said arbitrary amount differs by type of microwave oven.

13. The microwave oven according to claim 7, further comprising a receiving unit receiving recipe information including said heating control code corresponding to a desired recipe supplied through a communication network; wherein said code storing means stores said heating control code in correspondence with each of one or more recipes that are not objects of selection by said external operation.

14. The microwave oven according to claim 13, further has a movable heater; and said plurality of different pieces of procedure information include information indicating amount of movement of said heater.

* * * * *